US012422177B2

(12) United States Patent
Buescher et al.

(10) Patent No.: US 12,422,177 B2
(45) Date of Patent: Sep. 23, 2025

(54) MITIGATING COMPRESSOR LIQUID MIGRATION AND/OR FLOODBACK USING SUCTION TEMPERATURE SENSOR AND/OR LIQUID LEVEL SENSOR

(71) Applicant: Copeland Comfort Control LP, St. Louis, MO (US)

(72) Inventors: Thomas P. Buescher, Webster Groves, MO (US); Gregory E. Sisk, Farmington, MO (US); Charles P. Ketterer, St. Charles, MO (US); Frank S. Wallis, Sidney, OH (US)

(73) Assignee: Copeland Comfort Control LP, St. Louis, MO (US)

( * ) Notice: Subject to any disclaimer, the term of this patent is extended or adjusted under 35 U.S.C. 154(b) by 184 days.

(21) Appl. No.: 18/226,077

(22) Filed: Jul. 25, 2023

(65) Prior Publication Data

US 2023/0366596 A1 Nov. 16, 2023

Related U.S. Application Data

(63) Continuation of application No. 16/859,725, filed on Apr. 27, 2020, now Pat. No. 11,768,019.

(51) Int. Cl.

| | |
|---|---|
| ***F25B 49/02*** | (2006.01) |
| ***F04B 49/02*** | (2006.01) |
| ***F25B 41/00*** | (2021.01) |

(52) U.S. Cl.

CPC ..... *F25B 49/022* (2013.01); *F04B 49/02* (2013.01); *F25B 41/006* (2013.01); *F25B 2400/077* (2013.01); *F25B 2500/26* (2013.01)

(58) Field of Classification Search

CPC .. F25B 41/006; F25B 2400/077; F04B 49/02; F04B 2201/0803

See application file for complete search history.

(56) References Cited

U.S. PATENT DOCUMENTS

| | | | | |
|---|---|---|---|---|
| 4,748,343 | A | 5/1988 | Engel | |
| 5,278,426 | A * | 1/1994 | Barbier | G02B 5/04 250/577 |
| 5,732,564 | A | 3/1998 | Misawa et al. | |
| 6,434,958 | B1 * | 8/2002 | Koors | B60H 1/3207 62/227 |
| 6,578,373 | B1 * | 6/2003 | Barbier | G05D 23/1917 236/78 D |
| 6,647,346 | B1 | 11/2003 | Zikes | |
| 6,886,354 | B2 * | 5/2005 | Dudley | F04B 49/10 62/472 |
| 7,100,382 | B2 | 9/2006 | Butler et al. | |
| 7,444,824 | B1 | 11/2008 | Butler et al. | |

(Continued)

FOREIGN PATENT DOCUMENTS

CN 101382807 A * 3/2009

OTHER PUBLICATIONS

English Machine Translation of CN-101382807-A (Year: 2009).*
SureSwitch™ Multi-Voltage Contactor Upgrade; web accessed Dec. 14, 2018; 2 pgs.

*Primary Examiner* — Nathan C Zollinger
(74) *Attorney, Agent, or Firm* — Harness, Dickey & Pierce, P.L.C.; Anthony G. Fussner

(57) ABSTRACT

The present disclosure relates to controls and related methods for mitigating liquid (e.g., compressor refrigerant, etc.) migration and/or floodback.

23 Claims, 14 Drawing Sheets

(56) References Cited

U.S. PATENT DOCUMENTS

| | | | | |
|---|---|---|---|---|
| 7,464,561 | B1 | 12/2008 | Butler et al. | |
| 7,694,525 | B2 | 4/2010 | Butler et al. | |
| D696,208 | S | 12/2013 | Ling et al. | |
| D699,688 | S | 2/2014 | Ling et al. | |
| 9,791,175 | B2 | 10/2017 | Senf, Jr. | |
| 10,066,617 | B2 | 9/2018 | Pham | |
| 10,209,751 | B2 | 2/2019 | Zikes et al. | |
| 2003/0077179 | A1* | 4/2003 | Collins | F04B 49/065 417/63 |
| 2013/0211615 | A1 | 8/2013 | Zikes et al. | |
| 2021/0333026 | A1 | 10/2021 | Buescher et al. | |

* cited by examiner

| Temperature °F | NTC Resistance ohms | Applied Resistance ohms |
|---|---|---|
| -40 | 250,035 | 24,964.93 |
| -20 | 127,555 | 147,444.80 |
| -5 | 80,045 | 194,954.90 |
| 20 | 39,280 | 235,720.28 |
| 40 | 23,394 | 251,606.50 |

Processor's Setpoint 275,000 ohms

- Sealed potentiometer
  - Published resistance vs target temperature
  - Ohmmeter used to set the resistance

- OR -
- Insert calibrated resistor

MITIGATING COMPRESSOR LIQUID MIGRATION AND/OR FLOODBACK USING SUCTION TEMPERATURE SENSOR AND/OR LIQUID LEVEL SENSOR

CROSS-REFERENCE TO RELATED APPLICATION

This application is a continuation of allowed U.S. Non-Provisional application Ser. No. 16/859,725 filed Apr. 27, 2020, which published as US2021/0333026 on Oct. 28, 2021, which is incorporated herein by reference in its entirety.

FIELD

The present disclosure relates to and related methods for mitigating liquid (e.g., compressor refrigerant, etc.) migration and/or floodback.

BACKGROUND

This section provides background information related to the present disclosure which is not necessarily prior art.

Climate control systems (e.g., an air conditioning, heat pump systems, vapor compression refrigeration systems, etc.) typically include components such as compressors that are turned on and off by contactors in response to control (e.g., thermostat, etc.) signals. Such contactors are relatively expensive, and frequently provide no functionality except to connect and disconnect system components to and from electric power.

For example, a conventional vapor compression system may include a contactor for turning on and off a compressor. The compressor is operable for compressing a working fluid (e.g., refrigerant, etc.) received in vapor state via a suction line connected to an inlet of the compressor. The working fluid vapor is compressed and discharged from the compressor via an outlet at a relatively higher pressure.

DRAWINGS

The drawings described herein are for illustrative purposes only of selected embodiments and not all possible implementations, and are not intended to limit the scope of the present disclosure.

FIG. 9 also includes a table of customer established minimum return gas temperatures (° F.), NTC resistance (ohms), and applied resistance (ohms).

Corresponding reference numerals may indicate corresponding (though not necessarily identical) parts throughout the several views of the drawings.

DETAILED DESCRIPTION

Figure 1:
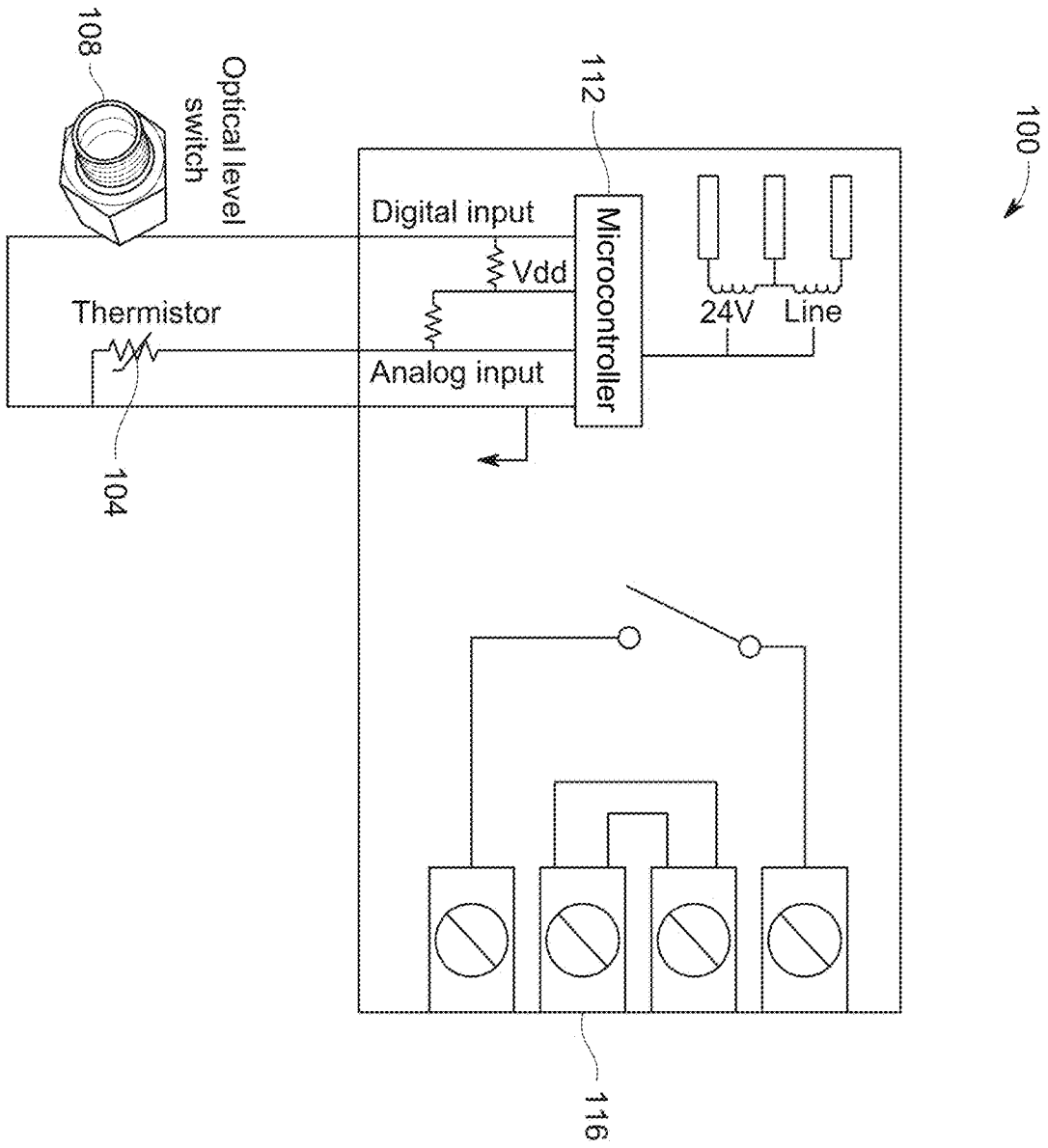
FIG. 1 illustrates an exemplary embodiment of a sensor-enabled control and a schematic wiring diagram that may be used for connecting a thermistor (broadly, a temperature sensor) and an optical level switch (broadly, a liquid detection sensor) with a microcontroller of the control.

Example embodiments will now be described more fully with reference to the accompanying drawings.

As recognized herein, conventional compressors pumping refrigerant have been prone to system failures of liquid migration, e.g., refrigerant migrates to the coldest location in the system when the compressor is off. Conventional compressors pumping refrigerant have also been prone to system failures of liquid floodback when liquid refrigerant returns to the compressor during the running cycle.

Refrigerant compressors have become more robust, such that a relatively small amount of the working fluid in liquid state returning to the compressor through the suction line may be acceptable but not welcomed. But large amounts of liquid migration or liquid floodback may cause main bearing wash out, piston, crank, connection rod failures, scroll set cracking, etc. Liquid migration and liquid floodback conditions tend to be more prone in commercial air conditioning or refrigeration vapor compression systems.

Liquid migration may occur during the OFF cycle of system demand, especially during colder ambient temperatures when the refrigerant migrates to the coldest location in the system (e.g., compressor sump, etc.) and tries to condense back to a liquid state. Conventional solutions to address liquid migration may include wrapping a conventional crank case heater around a bottom of the compressor.

Liquid floodback may occur during the ON cycle of system demand, when the evaporator section is full and refrigerant begins running over into the suction line. Liquid floodback may be caused by an undersized evaporator, too much system demand and not enough compressor capacity, and/or erroneous conditions, such as leaving a frozen food case door open for a relatively long period of time thereby calling for the expansion device to be full wide open to provide proper cooling of the evaporator. Conventional solutions to address liquid floodback may include installing a conventional mechanical suction regulator on small and mid-sized systems. For larger sized systems, conventional solutions to address liquid floodback may include installing conventional suction temperature probes to provide feedback to a master controller, and then relying upon the suction temperature alone and pressure-temperature (P-T) charts.

Disclosed herein are exemplary embodiments of controls (e.g., a contactor/relay/switch control, a relay switch control, a logic based switch configured with decision-making capabilities, etc.) that are sensor enabled and/or that include one or more terminals connectible with one or more external sensors (e.g., thermistor, other temperature sensor, optical level switch, optical level sensor, other liquid detection sensor, electrical current sensor, other external and/or add-on sensors, etc.). The information obtained by the one or more external sensors may allow the control (and/or a controller in communication with the control) to provide adaptive/advanced protection and control, such as customizable fault protection and recovery, discharge line temperature control and suction line floodback protection, liquid migration protection, startup protection, etc. In exemplary embodiments, the contactor/relay/switch control may generally include sensor(s), logic (e.g., via decision based electronics), and switch(es), and the logic may be analog, digital, and/or algorithm based.

In exemplary embodiments, a contactor/relay/switch control (broadly, a control) is configured to receive inputs from a controller (e.g., a master controller unit (MCU), etc.) to turn on and off a compressor of a system (e.g., vapor compression refrigeration system, other vapor compression system, etc.). The contactor/relay/switch control may be configured to use information (e.g., readings, inputs, feedback, etc.) obtained by one or more external sensors that are connected to the contactor/relay/switch control, e.g., via one or more terminals of the contactor/relay/switch control, etc. The contactor/relay/switch control (e.g., a printed circuit board of the contactor/relay/switch control, etc.) and/or the controller may be configured to make decisions (e.g., adjust operation of the compressor for system protection, etc.) based on the information obtained by the one or more external sensors and based on one or more instructions and/or commands (e.g., implemented via a firmware algorithm within a microprocessor, etc.). Accordingly, exemplary embodiments may provide or allow for adaptive/advanced system protection and control implemented via the contactor/relay/switch control (and/or via the controller in communication with the contactor/relay/switch control) using information obtained by the one or more external sensors and one or more instructions and/or comments (e.g., a firmware algorithm within a microprocessor, etc.) to adjust operation of the compressor.

In exemplary embodiments, one or more external sensors are coupled directly with a contactor/relay/switch control (broadly, a control) only via one or more terminals of the control. For example, an exemplary embodiment includes a temperature sensor (e.g., a suction line negative temperature coefficient (NTC) thermistor probe, etc.) coupled directly with a control. The temperature sensor is operable for obtaining suction line temperature readings.

Another exemplary embodiment includes an optical level switch (broadly, a liquid detection sensor) coupled directly with a contactor/relay/switch control (broadly, a control). The optical level switch is operable for detecting or sensing working fluid (e.g., refrigerant, etc.) in the liquid state (e.g., in the compressor sump, etc.). If no working fluid in the liquid state is sensed or detected, the control may proceed with energizing the compressor for normal operation. But if working fluid in the liquid state is sensed or detected by the optical level switch, the compressor is not energized (e.g., is not bump started or energized for normal operation, etc.) to allow for mitigation of liquid migration before the compressor is energized for normal operation as disclosed herein.

A further exemplary embodiment includes a temperature sensor (e.g., a suction line negative temperature coefficient (NTC) thermistor probe, etc.) and an optical level switch (broadly, a liquid detection sensor) coupled directly with a contactor/relay/switch control (broadly, a control). The temperature sensor is operable for obtaining suction line temperature readings. The optical level switch is operable for detecting or sensing working fluid in the liquid state. The information obtained by the optical level switch and the temperature sensor may be used for providing liquid floodback protection during the ON cycle of system demand as disclosed herein. Advantageously, the use of an optical level switch and a temperature sensor may provide a liquid floodback solution at a relatively lower cost than using conventional mechanical regulators, with less external leakage propensity, and more reliability than conventionally using temperature and pressure-temperature charts alone.

With reference now to the figures, FIG. 1 illustrates an exemplary embodiment of a control 100 embodying one or more aspects of the present disclosure. In this exemplary embodiment, a thermistor 104 (broadly, a temperature sensor) and an optical level switch 108 (broadly, a liquid detection sensor) are connected with a microcontroller 112 of the control 100.

The thermistor 104 is operable for providing an analog input to the microcontroller 112. The optical level switch 108 is operable for providing a digital input to the microprocessor 112. Stated differently, the microcontroller 112 is coupled for communication with and receives analog input signals from the thermistor 104. The microcontroller 112 is also coupled for communication with and receives digital input signals from the optical level switch 108.

The control 100 is connectable with components of an HVAC. For example, the housing of the control 100 may include openings in the upper housing portion or cover for terminal connections and connections to a compressor and fan, etc. Lug connectors 116 may be provided for line voltage inputs and outputs.

The microcontroller 112 of the control 100 is configured to receive control signals (e.g., signals from an indoor thermostat, etc.). The microcontroller 112 may be coupled for communication with and receive control signals via a micro input/out (IO) of a coil control circuit. For example, the microcontroller 112 may be coupled for communication with and receive control signals via a micro input/out (IO) of a coil control circuit as disclosed in U.S. patent application Ser. No. 16/691,095, the entire disclosure of which is incorporated herein by reference.

The thermistor 104 may be operable for obtaining suction line temperature readings. Information obtained by the thermistor 104 may be used for providing discharge line temperature control and suction line floodback protection.

Figure 4:
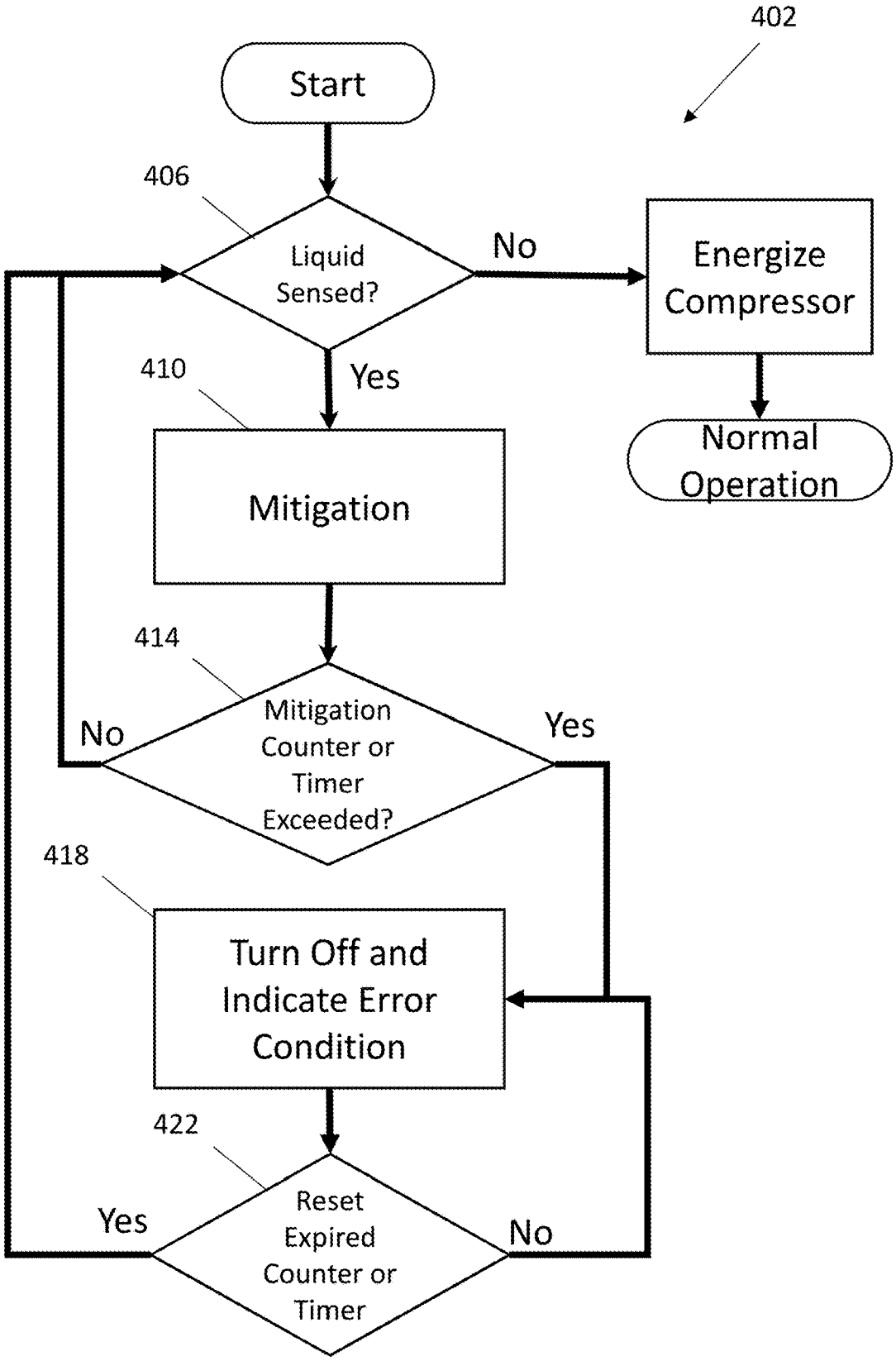
FIG. 4 is a flow chart illustrating an example method for mitigating liquid migration during an OFF cycle of system demand using an optical level switch (broadly, a liquid detection sensor) and a control such as shown in FIGS. 1 and 2.
Figure 5:
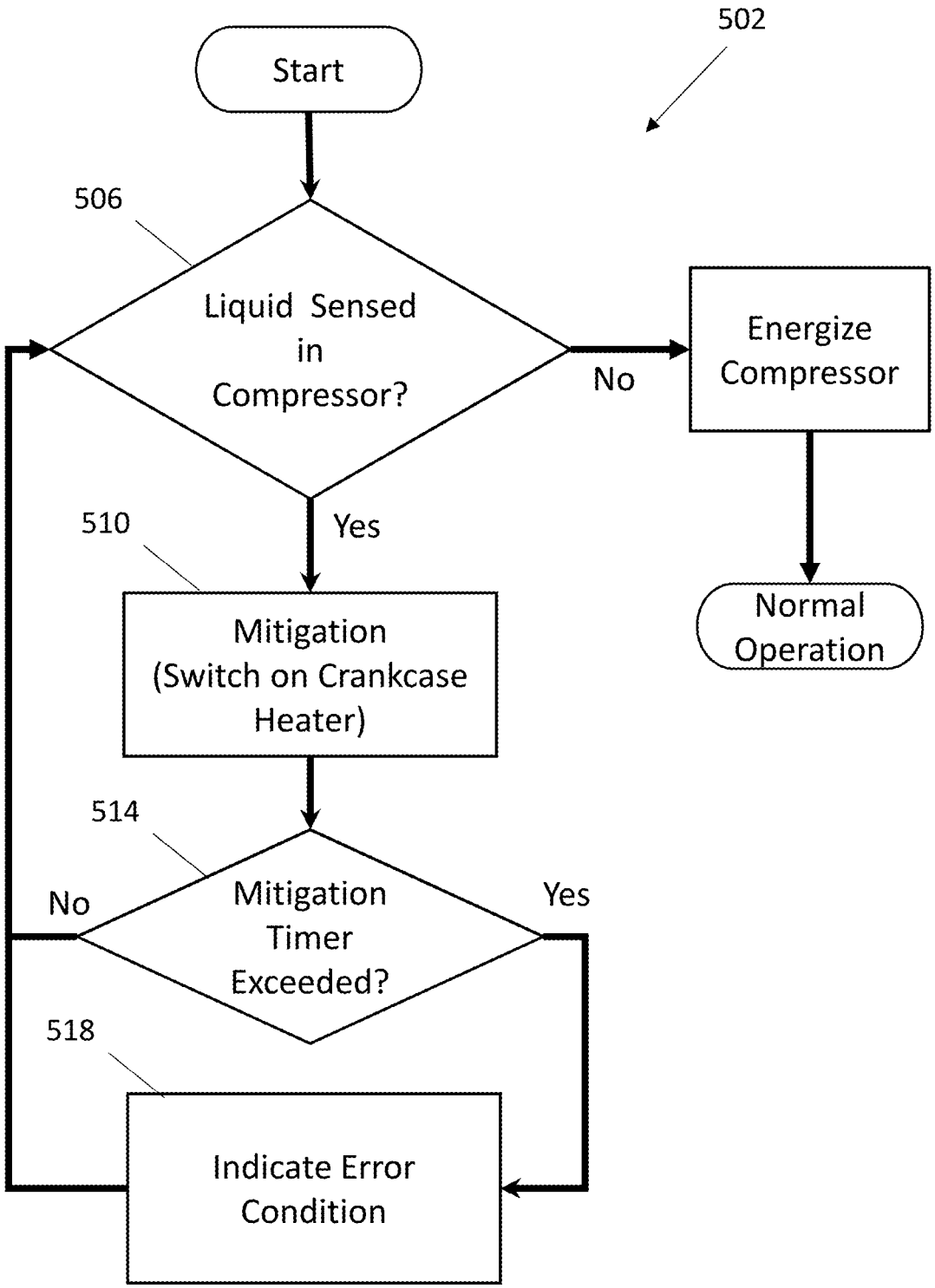
FIG. 5 is a flow chart illustrating another example method for mitigating liquid migration during an OFF cycle of system demand using a crankcase heater, an optical level switch (broadly, a liquid detection sensor), and a control such as shown in FIGS. 1 and 2.
Figure 6:
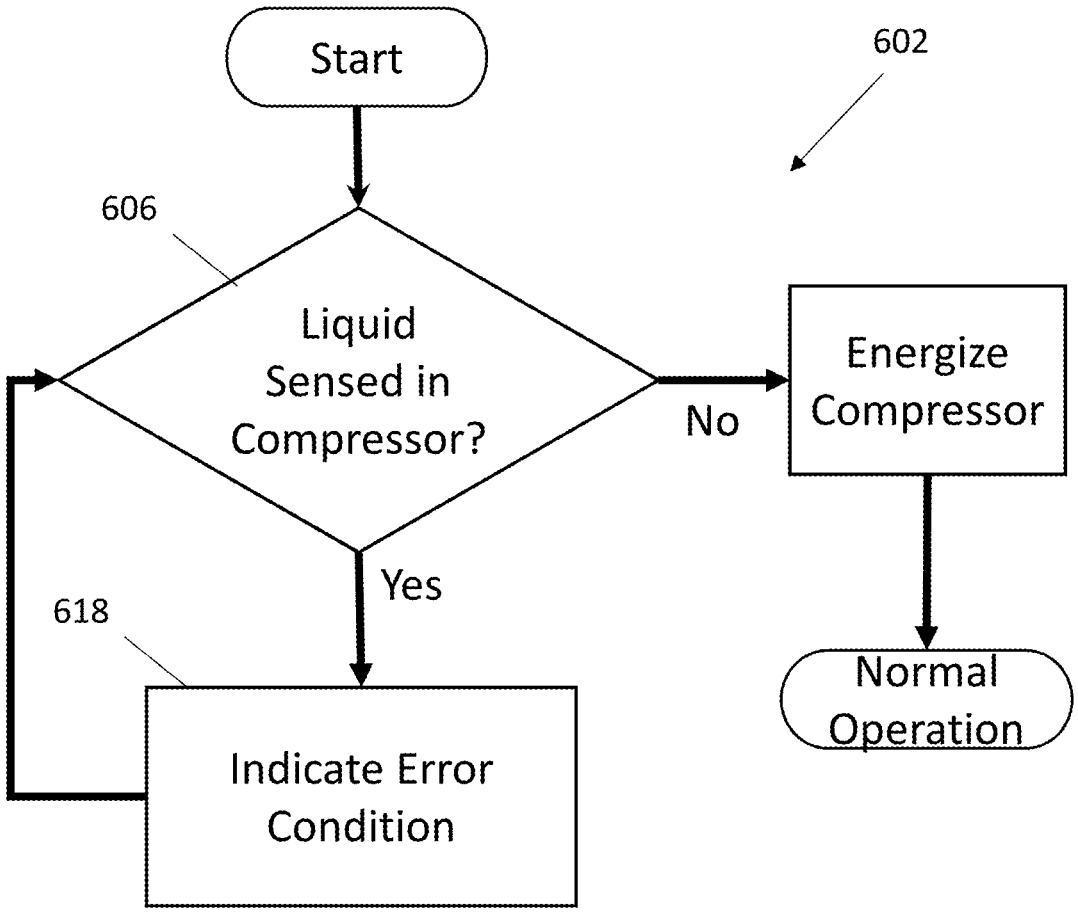
FIG. 6 is a flow chart illustrating an example method for providing an alert or indicating a liquid migration error condition during an OFF cycle of system demand using an optical level switch (broadly, a liquid detection sensor) and a control such as shown in FIGS. 1 and 2.

Information obtained by the optical level switch 108 may be used for providing liquid migration protection. For example, FIGS. 4-6 illustrate exemplary methods described below for providing liquid migration protection during an OFF cycle of system demand (e.g., protection against a flooded start of a compressor, etc.).

Figure 10:
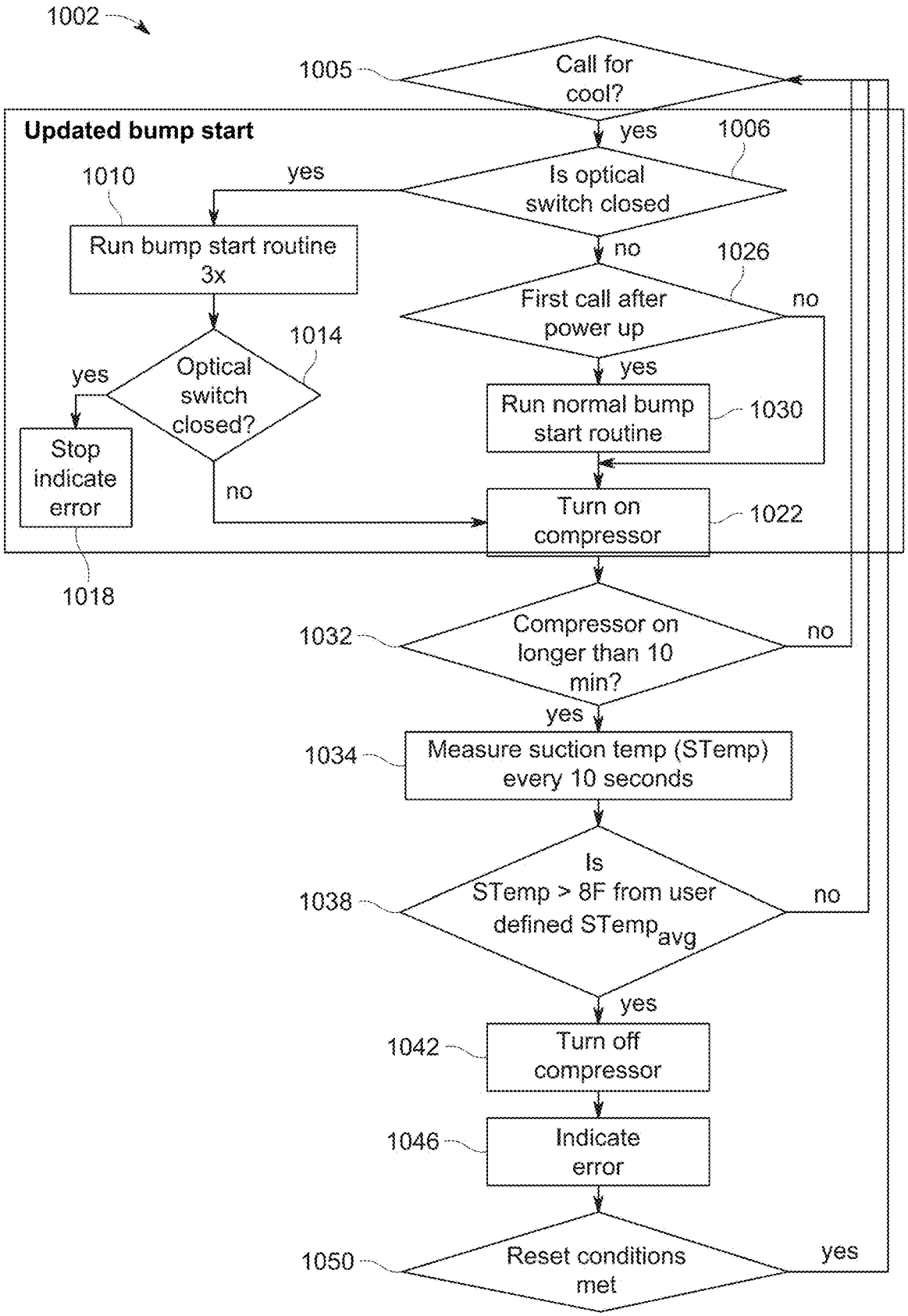
FIG. 10 is a flow chart illustrating an example method that includes an updated bump start process using an optical level switch, and floodback mitigation using a user-defined/user-determined floodback fault temperature.
Figure 11:
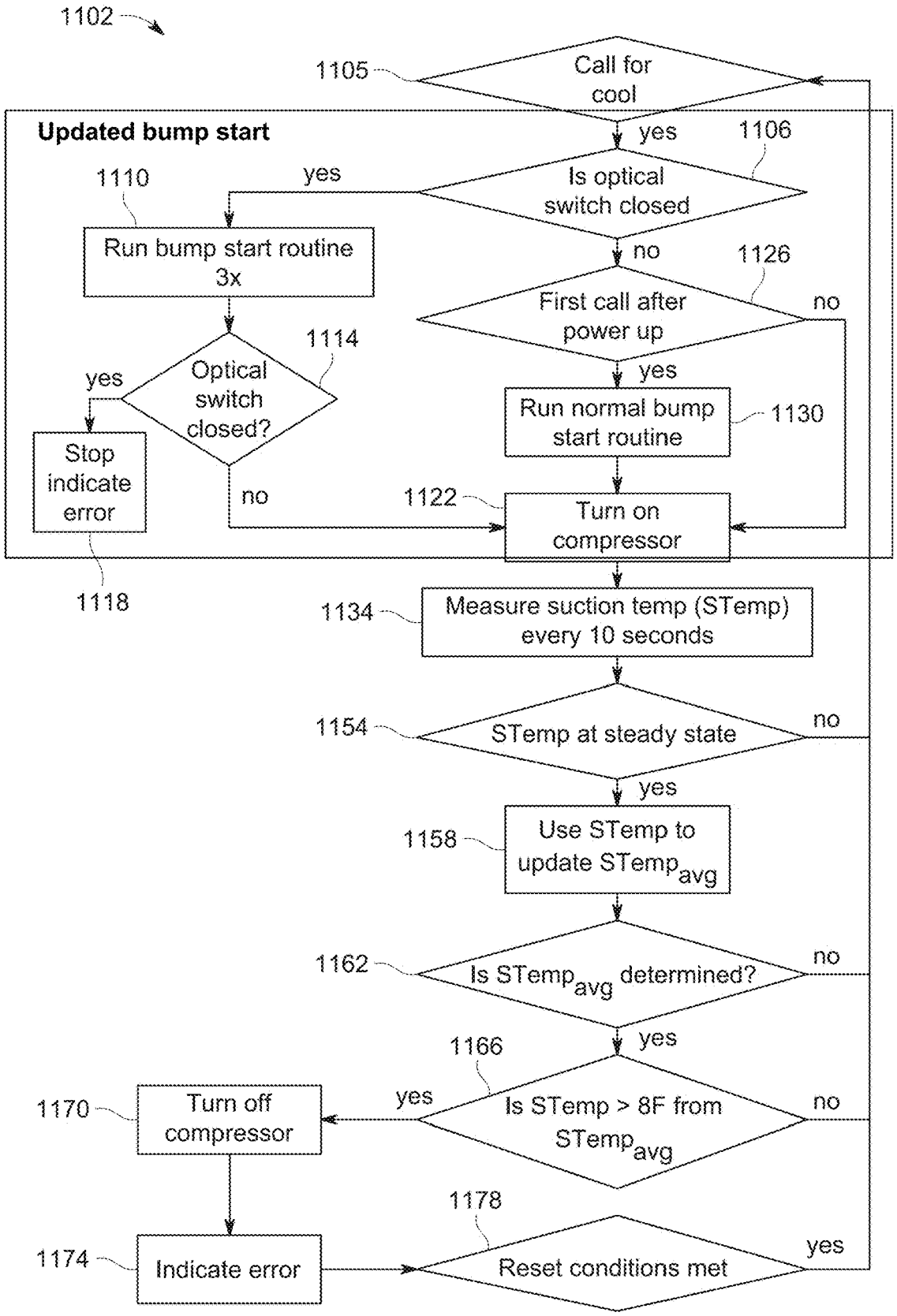
FIG. 11 is a flow chart illustrating another example method that includes an updated bump start process using an optical level switch, and floodback mitigation using an algorithm determined floodback fault temperature.

The information obtained by the optical level switch 108 and the thermistor 104 may be used for providing liquid floodback protection during the ON cycle of system demand. For example, FIGS. 10 and 11 illustrate exemplary methods described below for providing liquid floodback protection during the ON cycle of the system demand.

By way of example only, the optical level switch 108 (and/or other optical level switches disclosed herein) may comprise an optical level switch that is refrigerant compatible (e.g., compatible for use with $CO_2$, natural refrigerants, A1 and A2 refrigerant, etc.) and has one or more of the following specifications, e.g., nickel plated steel housing material, zinc plated steel male conduit connection, 36va pilot duty rated switch inductive rating, 2ma (without bleed resistor) minimum load, 3.5 ma AC power for operation, contact rating over 1 million cycles at rated load, glass centerline liquid lever switch point, pressure rating of 1000 PSI working and 5000 PSI burst, and/or 1.3 seconds internal time delay, etc. The optical level switch 108 may comprise a normally open optical level switch configured to be closable by working fluid in the liquid state within the compressor during an OFF cycle of system demand. Alternative optical level switches, optical level sensors, and/or liquid detection sensors may be used in other exemplary embodiments, such as a liquid level sensor with an analog output that has detection logic in the relay/switch control. For example, an alternative embodiment may include an analog device instead of a digital (on or off) binary optical level switch, where the analog device may comprises a probe (e.g., a capacitance type probe, etc.) that measures levels (e.g., 10% full, 30% full, 60% full, 100% full, etc.).

Figure 2:
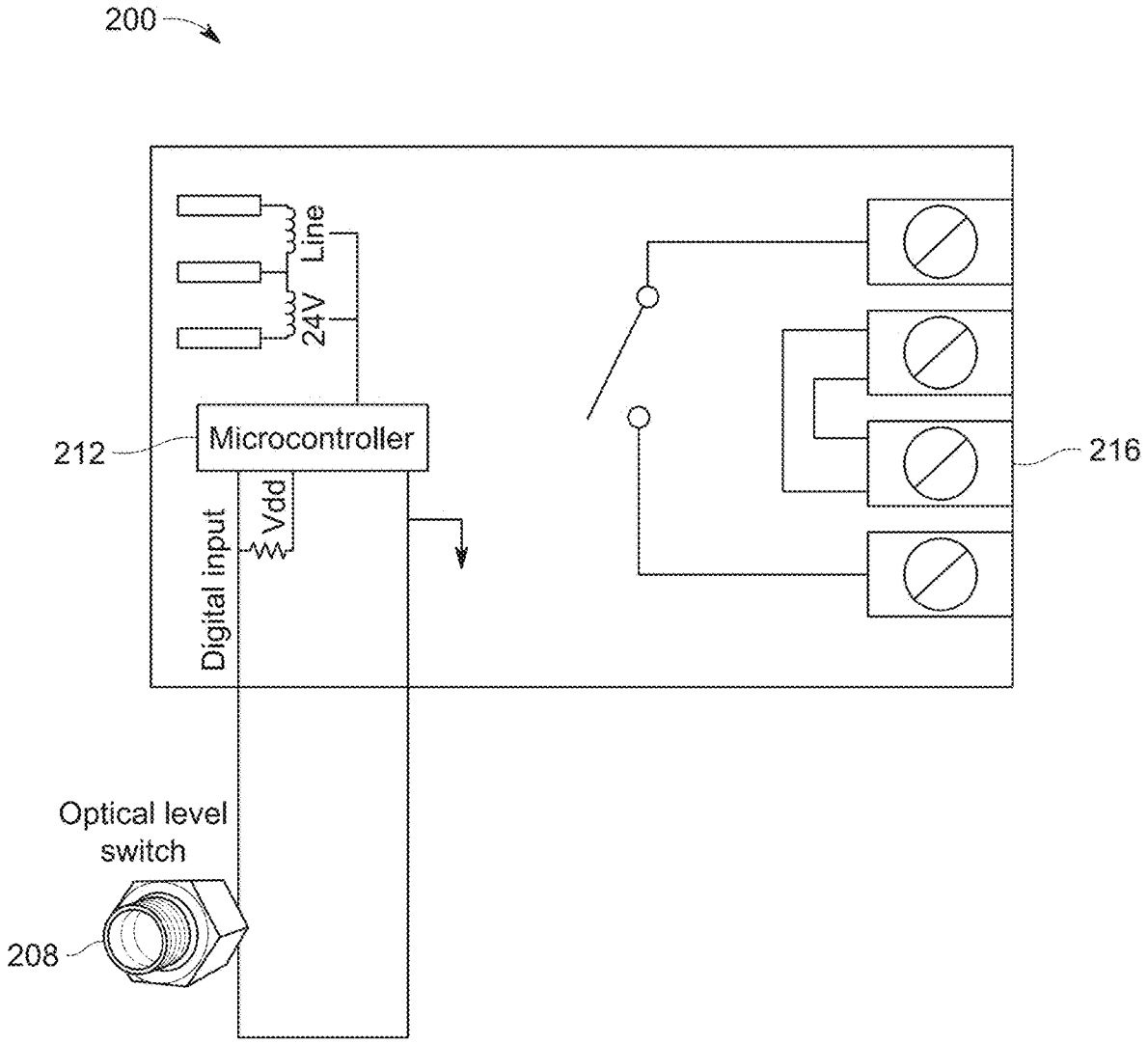
FIG. 2 illustrates another exemplary embodiment of a sensor-enabled control and a schematic wiring diagram that may be used for connecting an optical level switch (broadly, a liquid detection sensor) with a microcontroller of the control.

FIG. 2 illustrates an exemplary embodiment of a control 200 embodying one or more aspects of the present disclosure. In this exemplary embodiment, an optical level switch 208 (broadly, a liquid detection sensor) is connected with a microcontroller 212 of the control 200.

The optical level switch 208 is operable for providing a digital input to the microprocessor 212. Stated differently, the microcontroller 212 is coupled for communication with and receives digital input signals from the optical level switch 208.

The control 200 is connectable with components of an HVAC. For example, the housing of the control 200 may include openings in the upper housing portion or cover for terminal connections and connections to a compressor and fan, etc. Lug connectors 216 may be provided for line voltage inputs and outputs.

The microcontroller 212 of the control 200 is configured to receive control signals (e.g., signals from an indoor thermostat, etc.). The microcontroller 212 may be coupled for communication with and receive control signals via a micro input/out (IO) of a coil control circuit. For example, the microcontroller 212 may be coupled for communication with and receive control signals via a micro input/out (IO) of a coil control circuit as disclosed in U.S. patent application Ser. No. 16/691,095, the entire disclosure of which is incorporated herein by reference.

Figure 3:
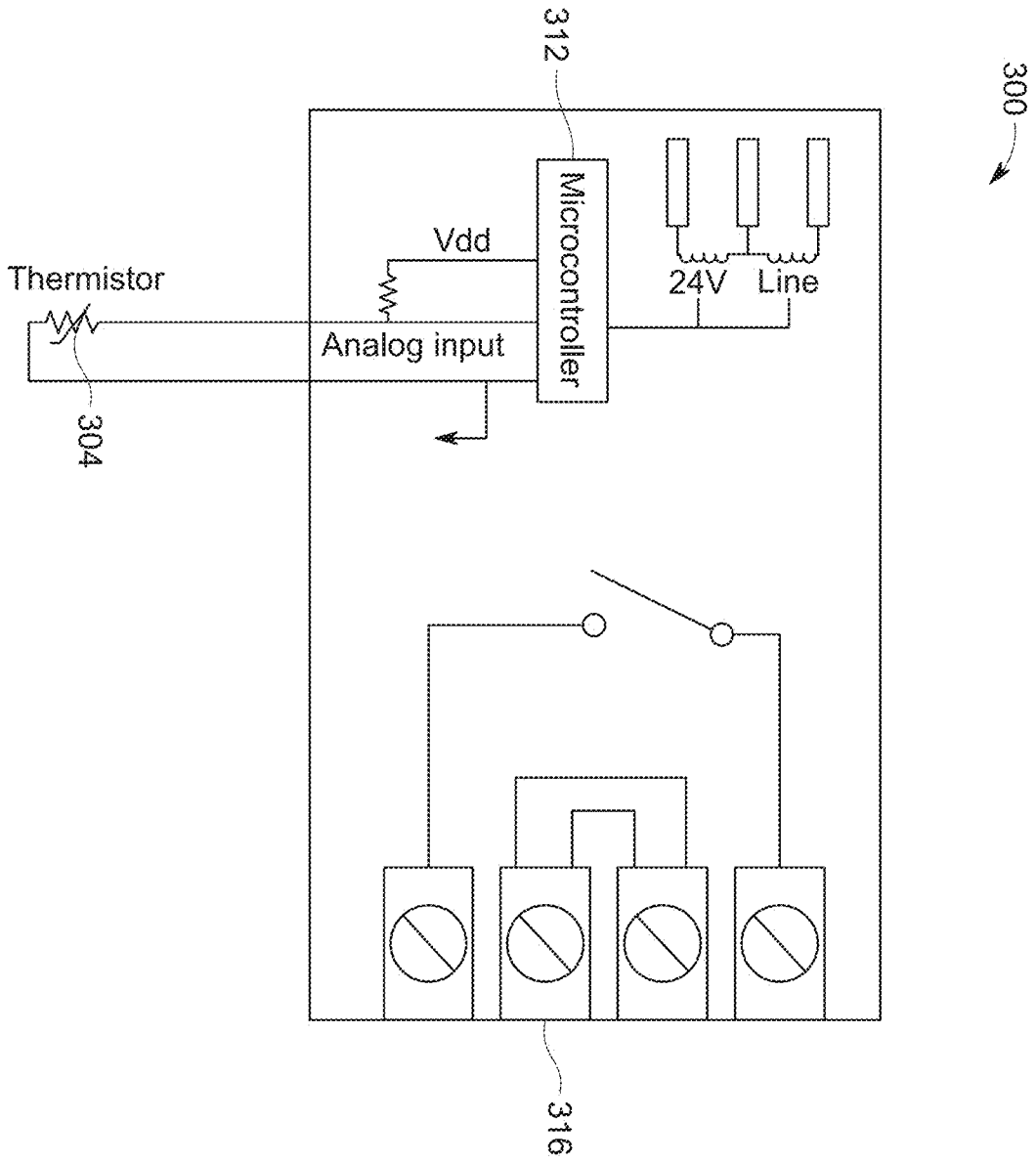
FIG. 3 illustrates another exemplary embodiment of a sensor-enabled control and a schematic wiring diagram that may be used for connecting a thermistor (broadly, a temperature sensor) with a microcontroller of the control.

FIG. 3 illustrates another exemplary embodiment of a control 300 embodying one or more aspects of the present disclosure. In this exemplary embodiment, a thermistor 304 (broadly, a temperature sensor) is connected with a microcontroller 312 of the control 300.

The thermistor 304 is operable for providing an analog input to the microcontroller 312. Stated differently, the microcontroller 312 is coupled for communication with and receives analog input signals from the thermistor 304.

The control 300 is connectable with components of an HVAC. For example, the housing of the control 300 may include openings in the upper housing portion or cover for terminal connections and connections to a compressor and fan, etc. Lug connectors 316 may be provided for line voltage inputs and outputs.

The microcontroller 312 of the control 300 is configured to receive control signals (e.g., signals from an indoor thermostat, etc.). The microcontroller 312 may be coupled for communication with and receive control signals via a micro input/out (IO) of a coil control circuit. For example, the microcontroller 312 may be coupled for communication with and receive control signals via a micro input/out (IO) of a coil control circuit as disclosed in U.S. patent application Ser. No. 16/691,095, the entire disclosure of which is incorporated herein by reference.

FIG. 4 is a flow chart illustrating an example method 402 for mitigating liquid migration during an OFF cycle of system demand using an optical level switch (broadly, a liquid detection sensor) connected with a control such as shown in FIGS. 1 and 2. As shown in in FIG. 4, if no liquid is sensed in the compressor at 406, then the compressor may be energized for normal operation. But if liquid is sensed in the compressor at 406 (e.g., by an optical level switch, etc.), liquid migration mitigation may be performed at 410 (e.g., turning on a crankcase heater, issuing an alert, etc.). If it is determined that a mitigation counter or timer (e.g., 10 seconds, more than 10 seconds, less than 10 seconds, etc.) is not exceeded at 414, then the method 402 returns back to 406 for determining if liquid is sensed. But if it is determined that the mitigation counter or timer is exceeded at 414, then the method 402 proceeds to 418 at which liquid migration mitigation efforts stop (e.g., crankcase heater turned off, etc.) and an alert or other indication of the error condition is generated. At 422, the expired mitigation counter or timer may be reset and the method 402 may then return to 406 for determining if liquid is sensed. But if the expired mitigation counter or timer has not been reset at 422, then the method 402 returns to 418 at which liquid migration mitigation efforts stop and an alert or other indication of the error condition is generated.

FIG. 5 is a flow chart illustrating another example method for mitigating liquid migration during an OFF cycle of system demand using a crankcase heater and an optical level switch (broadly, a liquid detection sensor) connected with a control such as shown in FIGS. 1 and 2. As shown in FIG. 5, if no liquid is sensed in the compressor at 506, then the compressor may be energized for normal operation. But if liquid is sensed in the compressor at 506 (e.g., by an optical level switch, etc.), liquid migration mitigation may be performed at 510. In this example method 502, the liquid migration mitigation includes switching on a crankcase heater. The crankcase heater may be operable to evaporate the liquid within about 10 minutes or other acceptable time interval. If it is determined that the mitigation timer is not exceeded at 514, then the method 502 returns back to 506 for determining if liquid is sensed in the compressor. But if is determined that the mitigation timer is exceeded (e.g., 10 minutes, etc.) at 514, then the method 502 proceeds to 518 at which an alert or other indication of the error condition is generated. Thereafter, the method returns to 506 for continued monitoring of the liquid migration condition and improvement thereof.

FIG. 6 is a flow chart illustrating an example method for providing an alert or indicating a liquid migration error condition during an OFF cycle of system demand using an optical level switch (broadly, a liquid detection sensor) connected with a control such as shown in FIGS. 1 and 2. As shown in FIG. 6, if no liquid is sensed in the compressor at 606, then the compressor may be energized for normal operation. But if liquid is sensed in the compressor at 606 (e.g., by an optical level switch, etc.), the method 602 proceeds to 618 at which an alert or other indication of the error condition is generated. In response to receiving the alert, one or more liquid migration mitigation efforts may be undertaken. And the method may return to 606 for continued monitoring of the liquid migration condition.

Figure 7:
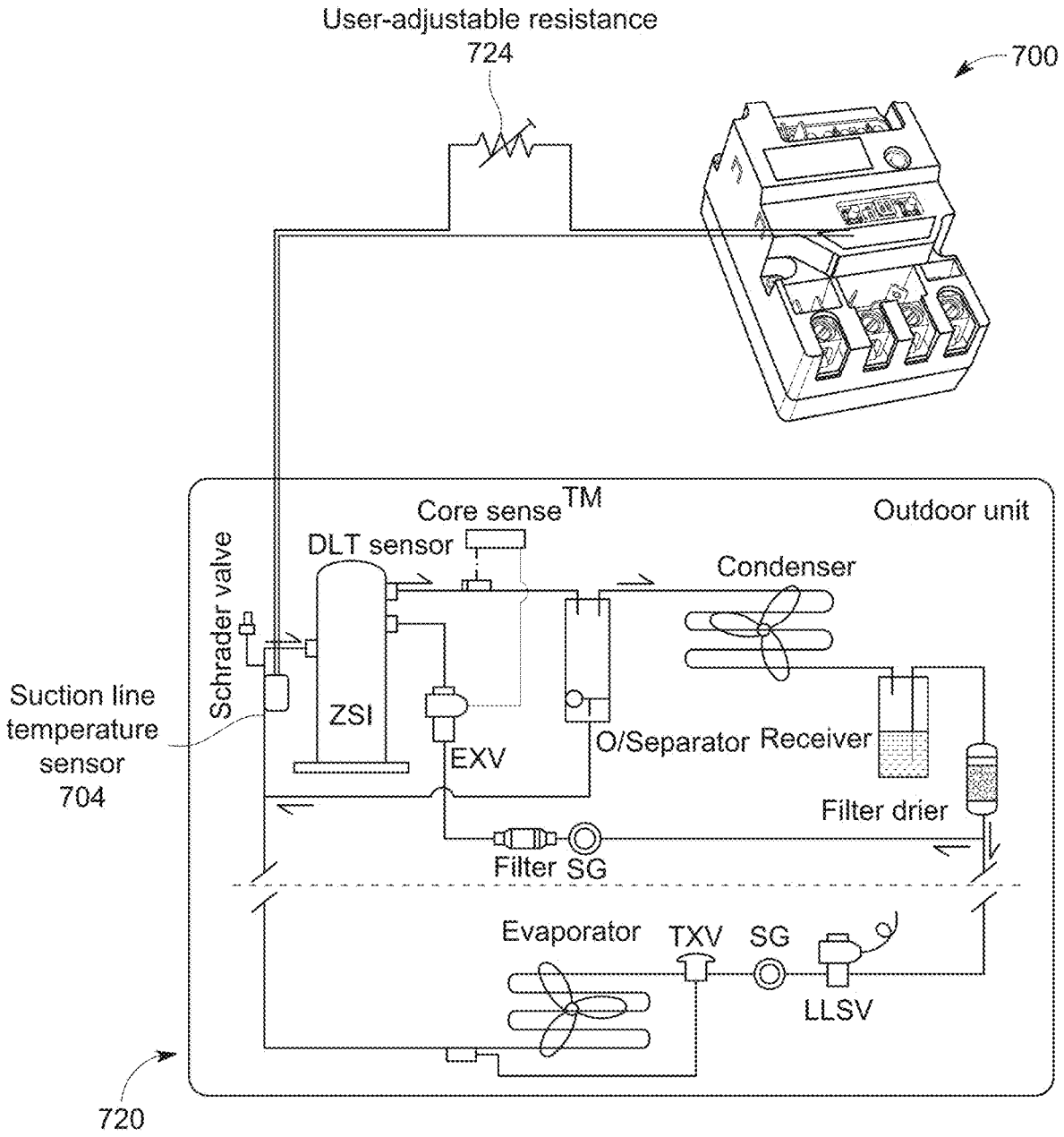
FIG. 7 illustrates components of an HVAC system, a control and a temperature sensor in series with user-adjustable resistance according to an exemplary embodiment.

FIG. 7 illustrates components of an HVAC system 720, a control 700, and a temperature sensor 704 (e.g., NTC thermistor, etc.) in series with user-adjustable resistance 724 according to an exemplary embodiment. The temperature sensor 704 is operable for obtaining suction line temperature readings. This exemplary embodiment may provide a floodback solution using the temperature sensor 704 to provide temperature input to the control 700 without requiring the use of an optical level sensor.

In an exemplary embodiment, an adjustable setpoint NTC thermistor may be used for providing steady state floodback protection. By way of example, a potentiometer user interface may be used to tune the trip temperature. Or, for example, the trip temperature may be tuned or changed by the changing the threshold in software via a user interface or remotely by a wired or wireless connection.

In an exemplary embodiment in which there is no pressure sensor for establishing true superheat and the application operates at a relatively consistent evaporating pressure, an exemplary method for provide floodback protection includes: using a suction line thermistor (e.g., temperature sensor 704 (FIG. 7), etc.) and programming a cut-out temperature of about 5 degrees Fahrenheit (° F.) above the nominal saturated temperature; using a temperature cut-out (or cut-in) switch as a digital input into the control, and using an optical switch to flag or detect floodback. Time delays may be programmed into the control to reduce nuisance trips.

Figure 8:
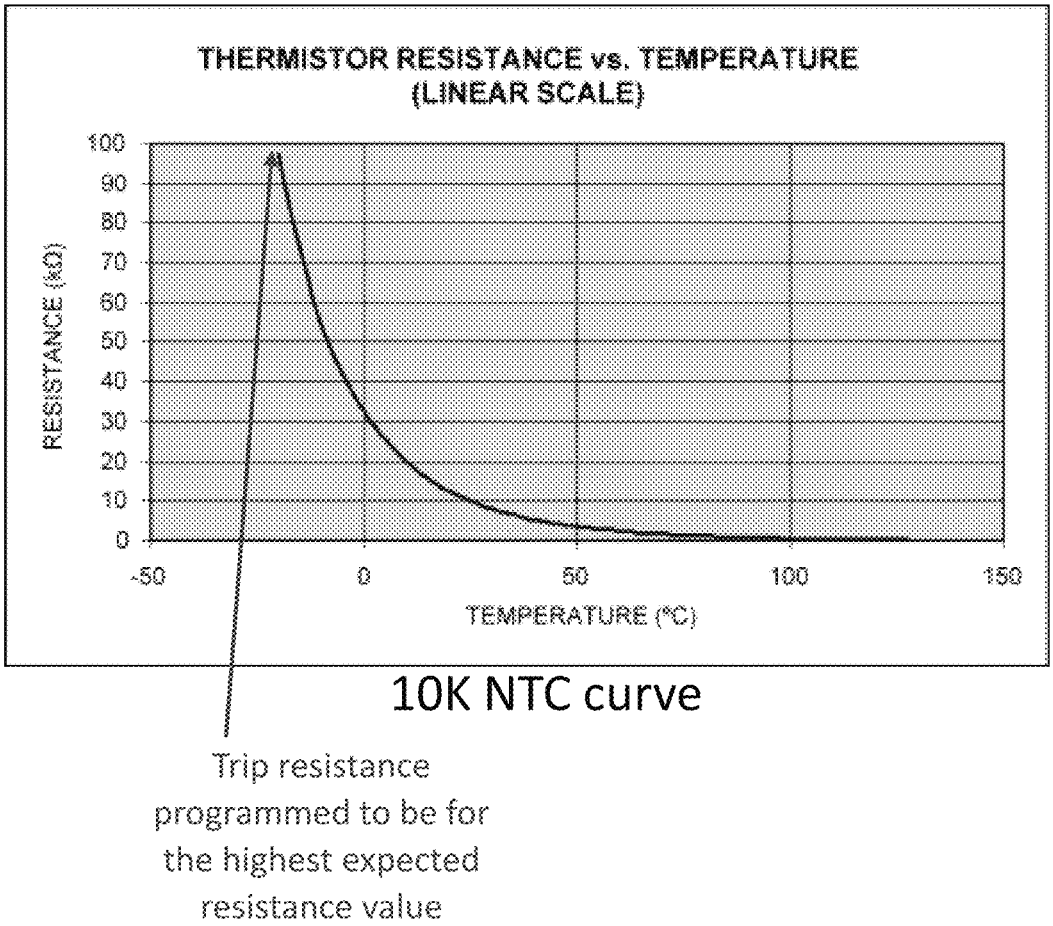
FIG. 8 is an exemplary line graph (linear scale) of thermistor resistance in kiloohms (kΩ) versus temperature in degrees Celsius (° C.).

In an exemplary embodiment, an on/off temperature switch (e.g., Thermo-o-Disc 60T series temperature switch, etc.) is operable as a digital input to the control. The temperature setting may be set to 5° F. or other appropriate target above the nominal evaporating setpoint. For example, an exemplary embodiment may include a contactor processor (e.g., microcontroller 312 (FIG. 3), etc.) programmed at the factory with one temperature setting for the trip temperature, such that there is no user configurable electronic settings. For example, FIG. 8 includes an exemplary line graph (linear scale) of thermistor resistance in kiloohms (kΩ) versus temperature in degrees Celsius (° C.). As shown in FIG. 8, trip resistance may be programmed to be for the highest expected resistance value.

Figure 9:
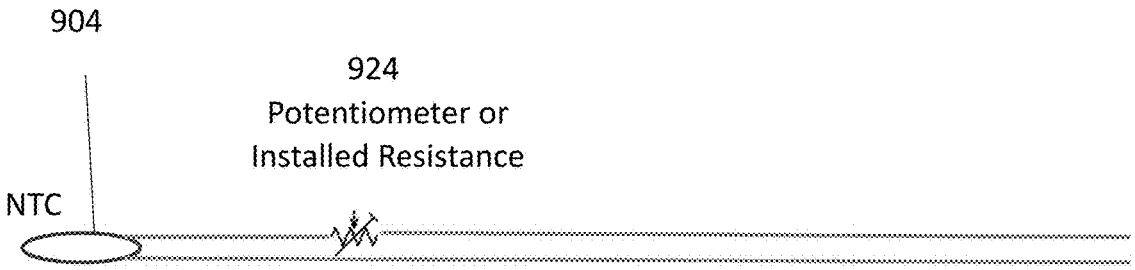
FIG. 9 illustrates an example negative temperature coefficient (NTC) thermistor and a potentiometer or installed resistance.

FIG. 9 illustrates an example NTC thermistor 904 and a potentiometer or installed resistance 924. FIG. 9 also includes a table of customer established minimum return gas temperatures (° F.), NTC resistance (ohms), and applied resistance (ohms), wherein the processor's setpoint is 275,000 ohms. An example option for providing the applied resistance includes a calibrated resistor. Another example option for providing the applied resistance includes a sealed potentiometer, which may include using published resistance versus target temperature or using an ohmmeter to set the resistance.

FIG. 10 is a flow chart illustrating an example method 1002 that includes an updated bump start process using an optical level switch, and floodback mitigation using a user-defined/user-determined floodback fault temperature. As disclosed herein, the method 1002 includes using a user-defined suction temperature average. By way of example, the method 1002 shown in FIG. 10 may be implemented using the control 100, OLS 108 (broadly, liquid detection sensor), and thermistor 104 (broadly, temperature sensor) shown in FIG. 1, etc.

After a call for cool 1005 the method 1002 includes running a compressor bump start routine at 1010 a predetermined number of times (e.g., 3 times, more or less than 3 times, etc.) if the optical level switch is closed at 1006 by liquid in the compressor. For example, the bump start routine at 1010 may include short cycling the compressor or running just a few seconds to help draw out any liquid while burning off. In a typical bump start sequence run at start up, the compressor may run for 2 seconds, then the compressor may be off for 5 seconds, and this sequence is repeated 3 times. In this exemplary embodiment, the method 1002 may include running this typical bump start sequence multiple times or sets (e.g., three times or sets, etc.) at 1010 with a predetermined amount of time (e.g., 15 seconds, etc.) between each set. For example, the bump start routine at 1010 may include 3 sets (with 15 seconds between each set of 3) of the following bump start process: running the compressor for 2 seconds, and then off for 5 seconds off, which on/off sequence is repeated 3 times, such that the overall bump start routine at 1010 includes a total of 9 short cycles to help ensure liquid is moved out of the system. The timings of the on cycle, off cycle, and intervals between set and the number of bumps may be changed (e.g., more or less than 2 seconds of run time, more or less than 5 seconds of off time, and/or more or less than 15 second delay between each set, etc.) based on a worst case scenario for the liquid to be moved out of a particular system.

After completion of the compressor bump start routine at 1010, the method 1002 includes determining if the optical level switch is closed at 1014. If the optical level switch is still closed due to liquid in the compressor after completion of the compressor bump start routine at 1010 then the method 1002 proceeds to 1018 at which liquid migration mitigation efforts stop and an alert or other indication of the error condition is generated. But if the optical level switch is open at 1014 and not closed by liquid in the compressor, then the compressor is turned on at 1022.

Referring back to the call for cool 1005, if the optical level switch is open at 1006 and not closed by liquid in the compressor, then the method 1002 includes determining at 1026 if the call for cool is the first call after power up. If it is determined at 1026 that the call for cool is not the first call for cool after power up, then the compressor is turned on at 1022. But if it is determined at 1026 that the call for cool is the first call for cool after power up, then the method 1002 includes running a normal compressor bump start routine at 1030. By way of example only, the normal compressor bump start routine at 1030 may include running the compressor for 2 seconds, then having the compressor off for 5 seconds, and then repeat this sequence 3 times. After completion of the normal compressor bump start routine at 1030, the compressor is turned on at 1022.

After the compressor is turned on at 1022, the method 1002 includes determining whether or not the compressor has been on for a predetermined amount of time or time interval (e.g., 10 minutes, a predetermined time interval greater or less than 10 minutes, etc.) at 1032. The predetermined time interval at 1032 may include any suitable time interval that is sufficiently long to allow the system to acclimate. If it is determined that the compressor has not been on for the predetermined time interval at 1032, then the method 1002 starts over and returns to the call for cool 1005.

But if it is determined that the compressor has been on for the predetermined time interval at 1032, then the method 1002 includes measuring suction temperature (STemp) at 1034 at predetermined time intervals (e.g., every 10 seconds, at a predetermined time interval greater or less than 10 seconds, etc.). At 1038, the method 1002 includes determining whether or not suction temperature (STemp) is greater than a predetermined (e.g., user defined, etc.) error threshold (e.g., +/−8° F., other error threshold higher or lower than 8° F., etc.) away from a user defined average suction temperature ($STemp_{avg}$). The comparison at 1038 may be debounced to prevent or reduce false trips.

If it is determined at 1038 that suction temperature (STemp) is not greater than the predetermined error threshold (e.g., +/−8° F., etc.) away from the user defined average suction temperature ($STemp_{avg}$), then the method 1002 starts over and returns to the call for cool 1005. But if it is determined at 1038 that suction temperature (STemp) is greater than the predetermined error threshold (e.g., +/−8° F., etc.) away from the user defined average suction temperature ($STemp_{avg}$), then the method 1002 includes turning off the compressor at 1042 and generating an alert or other indication of the error at 1046.

At 1050, the method 1002 includes determining whether or not reset condition(s) have been met. If it is determined at 1050 that the reset condition(s) have been met, then the method 1002 starts over and returns back to the call for cool 1005. The reset condition(s) at 1002 may be time based, temperature based, and/or may require a user or system monitor override. Also, the reset condition(s) may be different depending if the fault is on the high side or the low side. By way of example, determining whether or not the reset condition(s) have been met at 1050 may include determining whether the suction temperature (STemp) is greater than the reset temperature (ResetTemp), and if so, then method 1002 starts over and returns back to the call for cool 1005.

FIG. 11 is a flow chart illustrating an example method 1102 that includes an updated bump start process using an optical level switch, and floodback mitigation using an algorithm determined floodback fault temperature. As disclosed herein, the method 1102 includes using a moving average defined suction temperature average that changes with conditions over the life of a system, which, in turn, allows for reduction in the potential for fault alerts and detection of step changes in normal operation while allowing other aging based changes.

By way of example, the method 1102 shown in FIG. 11 may be implemented using the control 100, OLS 108 (broadly, liquid detection sensor), and thermistor 104 (broadly, temperature sensor) shown in FIG. 1, etc. With this exemplary method 1102, a potentiometer or other user interface may be used that allows the user to shift (e.g., tailor, customize, optimize, etc.) the threshold for a specific system.

After a call for cool 1105, the method 1102 includes running a compressor bump start routine at 1110 a predetermined number of times (e.g., 3 times, more or less than 3 times, etc.) if the optical level switch is closed at 1106 by liquid in the compressor. For example, the bump start routine at 1110 may include short cycling the compressor or running just a few seconds to help draw out any liquid while burning off. In a typical bump start sequence run at start up, the compressor may run for 2 seconds, then the compressor may be off for 5 seconds, and this sequence is repeated 3 times. In this exemplary embodiment, the method 1102 may include running this typical bump start sequence multiple times or sets (e.g., three times or sets, etc.) at 1110 with a predetermined amount of time (e.g., 15 second interval or delay, etc.) between each set. For example, the bump start routine at 1110 may include 3 sets (with 15 second interval or delay between each set of 3) of the following bump start process: running the compressor for 2 seconds, then the compressor is off for 5 seconds off, which on/off sequence is repeated 3 times, such that the overall bump start routine at 1110 includes a total of 9 short cycles to help ensure liquid is moved out of the system. The timings of the on cycle, off cycle, and intervals between set and the number of bumps may be changed (e.g., more or less than 2 seconds of run time, more or less than 5 seconds of off time, and/or more or less than 15 second delay between each set, etc.) based on a worst case scenario for the liquid to be moved out of a particular system.

After completion of the compressor bump start routine at 1110, the method 1102 includes determining if the optical level switch is closed at 1114. If the optical level switch is still closed due to liquid in the compressor after completion of the compressor bump start routine at 1110 then the method 1102 proceeds to 1118 at which liquid migration mitigation efforts stop and an alert or other indication of the error condition is generated. But if the optical level switch is open at 1114 and not closed by liquid in the compressor, then the compressor is turned on at 1122.

Referring back to the call for cool 1105, if the optical level switch is open at 1106 and not closed by liquid in the compressor, then the method 1102 includes determining at 1126 if the call for cool is the first call after power up. If it is determined at 1126 that the call for cool is not the first call for cool after power up, then the compressor is turned on at 1122. But if it is determined at 1126 that the call for cool is the first call for cool after power up, then the method 1102 includes running a normal compressor bump start routine at 1130. By way of example only, the normal compressor bump start routine at 1130 may include running the compressor for 2 seconds, then having the compressor off for 5 seconds, and then repeat this sequence 3 times. After completion of the normal compressor bump start routine at 1130, then the compressor is turned on at 1122.

After the compressor is turned on at 1122, the method 1102 includes measuring suction temperature (STemp) at 1134 at predetermined time intervals (e.g., every 10 seconds, at a predetermined time interval greater or less than 10 seconds, etc.).

At 1154, the method 1102 includes determining whether or not suction temperature (STemp) is at steady state. Steady state may be a time based delay or algorithm determined. An example of an algorithm determination includes comparing previous readings of suction temperature (STemp) to determine if the rate of change of suction temperature (STemp) is below a threshold.

If it is determined at 1154 that suction temperature (STemp) is not at steady state, then the method 1102 starts over and returns back to the call for cool 1105. But if it is determined at 1154 that suction temperature (STemp) is at steady state, then the method 1102 proceeds to 1158 at which suction temperature (STemp) is used to update suction temperature average ($STemp_{avg}$). Suction temperature average ($STemp_{avg}$) may be updated by multiple methods, such as a moving average, an allowable incrementing of the temperature up or down based on suction temperature (STemp), and/or other methods of filtering or debouncing, etc.

After suction temperature average ($STemp_{avg}$) has been updated, the method 1102 proceeds to step 1162 at which a decision is made whether or not suction temperature average ($STemp_{avg}$) is determined. After power up, the compressor may need to be run a sufficient amount of time for acclimation to allow suction temperature average ($STemp_{avg}$) to be determined. The amount of time for acclimation may vary depending on the particular system, such 10-15 minutes of system acclimation time, less 10 minutes of system acclimation time, more than 15 minutes of system acclimation time, etc. As another example, a certain number of cycles may need to be run after power up to allow for system acclimation and/or determination of the suction temperature average ($STemp_{avg}$).

If the decision at 1162 is that the suction temperature average ($STemp_{avg}$) has not yet been determined, then the method 1102 starts over and returns back to the call for cool 1105. But if the decision at 1162 is that the suction temperature average ($STemp_{avg}$) has been determined, then the method 1102 proceeds to 1166.

At 1166, the method 1102 includes determining whether or not suction temperature (STemp) is greater than a predetermined (e.g., user defined, etc.) error threshold (e.g., +/−8° F., other error threshold higher or lower than 8° F., etc.) away from a user defined average suction temperature ($STemp_{avg}$). The comparison at 1166 may be debounced to prevent or reduce false trips.

If it is determined at 1166 that suction temperature (STemp) is not greater than the predetermined error threshold (e.g., +/−8° F., etc.) away from the user defined average suction temperature ($STemp_{avg}$), then the method 1102 starts over and returns to the call for cool 1105. But if it is determined at 1166 that suction temperature (STemp) is greater than the predetermined error threshold (e.g., +/−8° F., etc.) away from the user defined average suction temperature ($STemp_{avg}$), then the method 1102 includes turning off the compressor at 1170 and generating an alert or other indication of the error at 1174.

At 1178, the method 1102 includes determining whether or not reset condition(s) have been met. If it is determined at 1178 that the reset condition(s) have been met, then the method 1102 starts over and returns back to the call for cool 1105. The reset condition(s) at 1178 may be time based, temperature based, and/or may require a user or system monitor override. Also, the reset condition(s) may be different depending if the fault is on the high side or the low side. By way of example, determining whether or not the reset condition(s) have been met at 1178 may include determining whether the suction temperature (STemp) is greater than the reset temperature (ResetTemp), and if so, then method 1102 starts over and returns back to the call for cool 1105.

Figure 12:
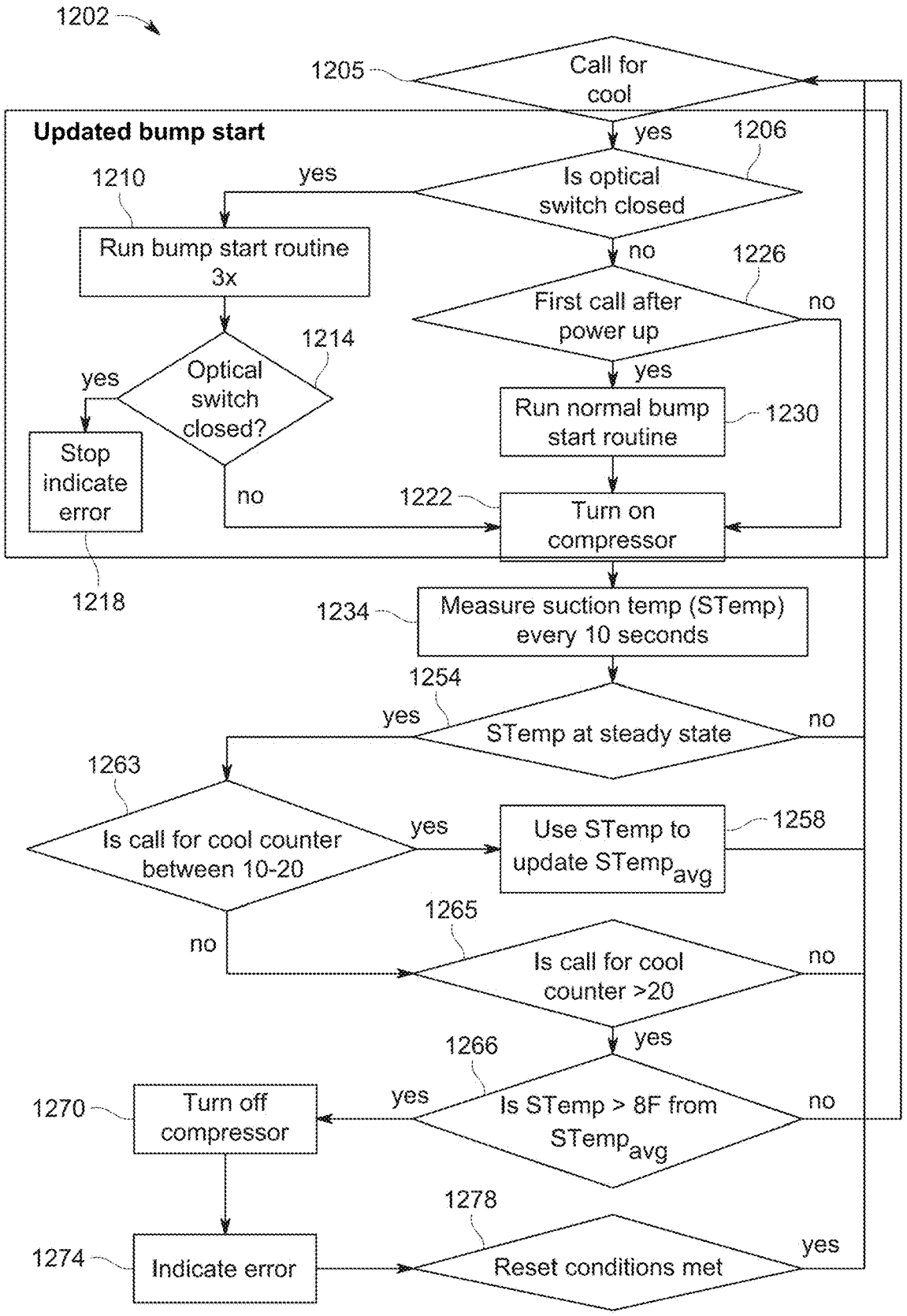
FIG. 12 is a flow chart illustrating another example method that includes an updated bump start process using an optical level switch, and floodback mitigation using an algorithm determined floodback fault temperature.

FIG. 12 is a flow chart illustrating an example method 1202 that includes an updated bump start process using an optical level switch, and floodback mitigation using an algorithm determined floodback fault temperature. As disclosed herein, the method 1202 includes using a suction temperature average that is determined soon after the system is commissioned or serviced to thereby baseline the optimal suction temperature, and allow the system/method to error when it deviates from this baseline. This exemplary method 1202 includes using initial commissioning conditions as a baseline, which may allow for identification of floodback or other conditions like low charge or dirty heat exchangers. According to this exemplary embodiment, the system may be configured to determine an average suction temperature at initial startup, with the expectation that at commissioning, the system will be running at optimum conditions. This average suction temperature may be stored by the system, e.g., in non-volatile memory, etc. Also, a call for cool counter may be manually reset to all the system to learn a new average suction temperature.

By way of example, the method 1202 shown in FIG. 12 may be implemented using the control 100, OLS 108 (broadly, liquid detection sensor), and thermistor 104 (broadly, temperature sensor) shown in FIG. 1, etc. With this exemplary method 1202, a potentiometer or other user interface may be used that allows the user to shift (e.g., tailor, customize, optimize, etc.) the threshold for a specific system.

After a call for cool 1205, the method 1202 includes running a compressor bump start routine at 1210 a predetermined number of times (e.g., 3 times, more or less than 3 times, etc.) if the optical level switch is closed at 1206 by liquid in the compressor. For example, the bump start routine at 1210 may include short cycling the compressor or running just a few seconds to help draw out any liquid while burning off. In a typical bump start sequence run at start up, the compressor may run for 2 seconds, then the compressor may be off for 5 seconds, and this sequence is repeated 3 times. In this exemplary embodiment, the method 1202 may include running this typical bump start sequence multiple times or sets (e.g., three times or sets, etc.) at 1210 with a predetermined amount of time (e.g., 15 second interval or delay, etc.) between each set. For example, the bump start routine at 1210 may include 3 sets (with 15 second interval or delay between each set of 3) of the following bump start process: running the compressor for 2 seconds, then the compressor is off for 5 seconds off, which on/off sequence is repeated 3 times, such that the overall bump start routine at 1210 includes a total of 9 short cycles to help ensure liquid is moved out of the system. The timings of the on cycle, off cycle, and intervals between set and the number of bumps may be changed (e.g., more or less than 2 seconds of run time, more or less than 5 seconds of off time, and/or more or less than 15 second delay between each set, etc.) based on a worst case scenario for the liquid to be moved out of a particular system.

After completion of the compressor bump start routine at 1210, the method 1202 includes determining if the optical level switch is closed at 1214. If the optical level switch is still closed due to liquid in the compressor after completion of the compressor bump start routine at 1210 then the method 1202 proceeds to 1218 at which liquid migration mitigation efforts stop and an alert or other indication of the error condition is generated. But if the optical level switch is open at 1214 and not closed by liquid in the compressor, then the compressor is turned on at 1222.

Referring back to the call for cool 1205, if the optical level switch is open at 1206 and not closed by liquid in the compressor, then the method 1202 includes determining at 1226 if the call for cool is the first call after power up. If it is determined at 1226 that the call for cool is not the first call for cool after power up, then the compressor is turned on at 1222. But if it is determined at 1226 that the call for cool is the first call for cool after power up, then the method 1202 includes running a normal compressor bump start routine at 1230. By way of example only, the normal compressor bump start routine at 1230 may include running the compressor for 2 seconds, then having the compressor off for 5 seconds, and then repeat this sequence 3 times. After completion of the normal compressor bump start routine at 1230, then the compressor is turned on at 1222.

After the compressor is turned on at 1222, the method 1202 includes measuring suction temperature (STemp) at 1234 at predetermined time intervals (e.g., every 10 seconds, at a predetermined time interval greater or less than 10 seconds, etc.).

At 1254, the method 1202 includes determining whether or not suction temperature (STemp) is at steady state. Steady state may be a time based delay or algorithm determined. An example of an algorithm determination includes comparing previous readings of suction temperature (STemp) to determine if the rate of change of suction temperature (STemp) is below a threshold.

If it is determined at 1254 that suction temperature (STemp) is not at steady state, then the method 1202 starts over and returns back to the call for cool 1205. But if it is determined at 1254 that suction temperature (STemp) is at steady state, then the method 1202 proceeds to 1263.

At 1263, the method 1202 includes determining whether or not a call for cool is between a predetermined range (e.g., 10-20 cycles, etc.). After power up, the compressor may need to run a certain number of cycles to allow for system acclimation and/or determination of the suction temperature average ($STemp_{avg}$).

If it is determined at 1263 that the call for cool counter is within the predetermined range, then the method proceeds to 1258 at which suction temperature (STemp) is used to update suction temperature average ($STemp_{avg}$). Suction temperature average ($STemp_{avg}$) may be updated by multiple methods, such as a moving average, an allowable incrementing of the temperature up or down based on suction temperature (STemp), and/or other methods of filtering or debouncing, etc. After suction temperature average ($STemp_{avg}$) has been updated at 1258, then the method 1202 starts over and returns to the call for cool 1205.

But if it is determined at 1263 that the call for cool counter is not within the predetermined range, then the method proceeds to 1265 at which it is determined whether or not the call for cool counter is greater than or equal to the upper limit (e.g., 20, etc.) of the predetermined range (e.g., 10-20 cycles, etc.). If the call for cool counter is not determined to be greater than or equal to the upper limit of the predetermined range, then the method 1202 starts over and returns to the call for cool 1205.

But if it is determined at 1265 that the call for cool counter is greater than or equal to the upper limit of the predetermined range, then the method 1202 proceeds to 1266. At 1266, the method 1202 includes determining whether or not suction temperature (STemp) is greater than a predetermined (e.g., user defined, etc.) error threshold (e.g., +/−8° F., other error threshold higher or lower than 8° F., etc.) away from the average suction temperature ($STemp_{avg}$). The comparison at 1266 may be debounced to prevent or reduce false trips.

If it is determined at 1266 that suction temperature (STemp) is not greater than the predetermined error threshold (e.g., +/−8° F., etc.) away from the user defined average suction temperature ($STemp_{avg}$), then the method 1202 starts over and returns to the call for cool 1205. But if it is determined at 1266 that suction temperature (STemp) is greater than the predetermined error threshold (e.g., +/−8° F., etc.) away from the user defined average suction temperature ($STemp_{avg}$), then the method 1202 includes turning off the compressor at 1270 and generating an alert or other indication of the error at 1274.

At 1278, the method 1202 includes determining whether or not reset condition(s) have been met. If it is determined at 1278 that the reset condition(s) have been met, then the method 1202 starts over and returns back to the call for cool 1205. The reset condition(s) at 1278 may be time based, temperature based, and/or may require a user or system monitor override. Also, the reset condition(s) may be different depending if the fault is on the high side or the low side. By way of example, determining whether or not the reset condition(s) have been met at 1278 may include determining whether the suction temperature (STemp) is greater than the reset temperature (ResetTemp), and if so, then method 1202 starts over and returns back to the call for cool 1205.

Figure 13:
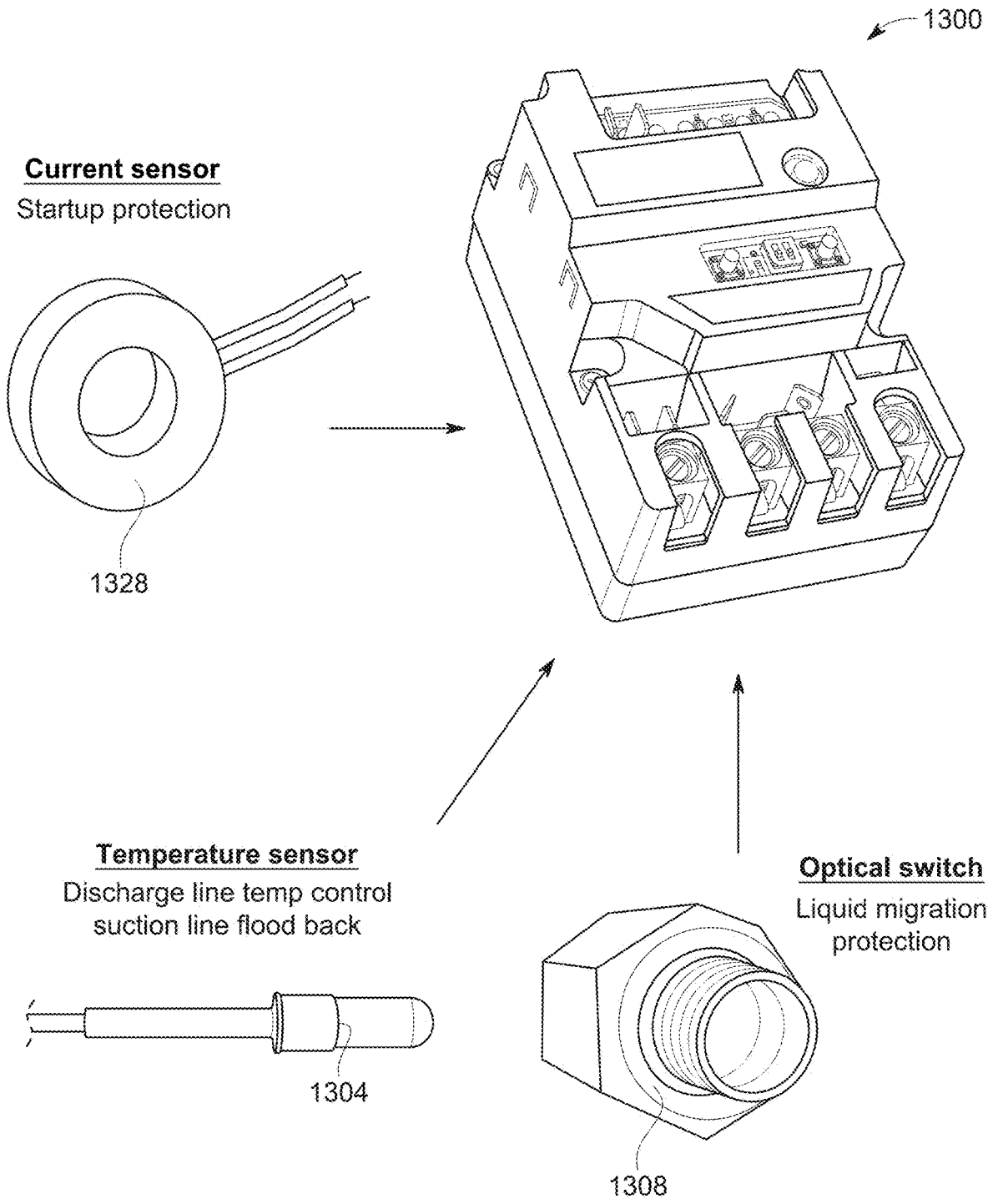
FIG. 13 illustrates an exemplary temperature sensor (e.g., a thermistor, etc.), optical level switch (broadly, a liquid detection sensor), and electrical current sensor that may be connected to a control according to an exemplary embodiment.

FIG. 13 illustrates an exemplary embodiment of a control 1200, which may include the circuit shown in FIG. 1. FIG. 13 also illustrates an exemplary temperature sensor 1204 (e.g., a thermistor, etc.), optical level switch 1208 (broadly, a liquid detection sensor), and electrical current sensor 1228 that may be connected to the control 1200. As disclosed herein, the temperature sensor 1204 may be connected with the control 1204, which may use information obtained by temperature sensor to provide discharge line temperature control and suction line floodback protection. The optical level switch (OLS) 1208 may be connected with the control, which may use information obtained by the optical level switch 1208 to provide liquid migration protection. The electrical current sensor 1228 may be connected with the control 1200, which may use information obtained by the electrical current sensor 1228 to provide startup protection.

Figure 14:
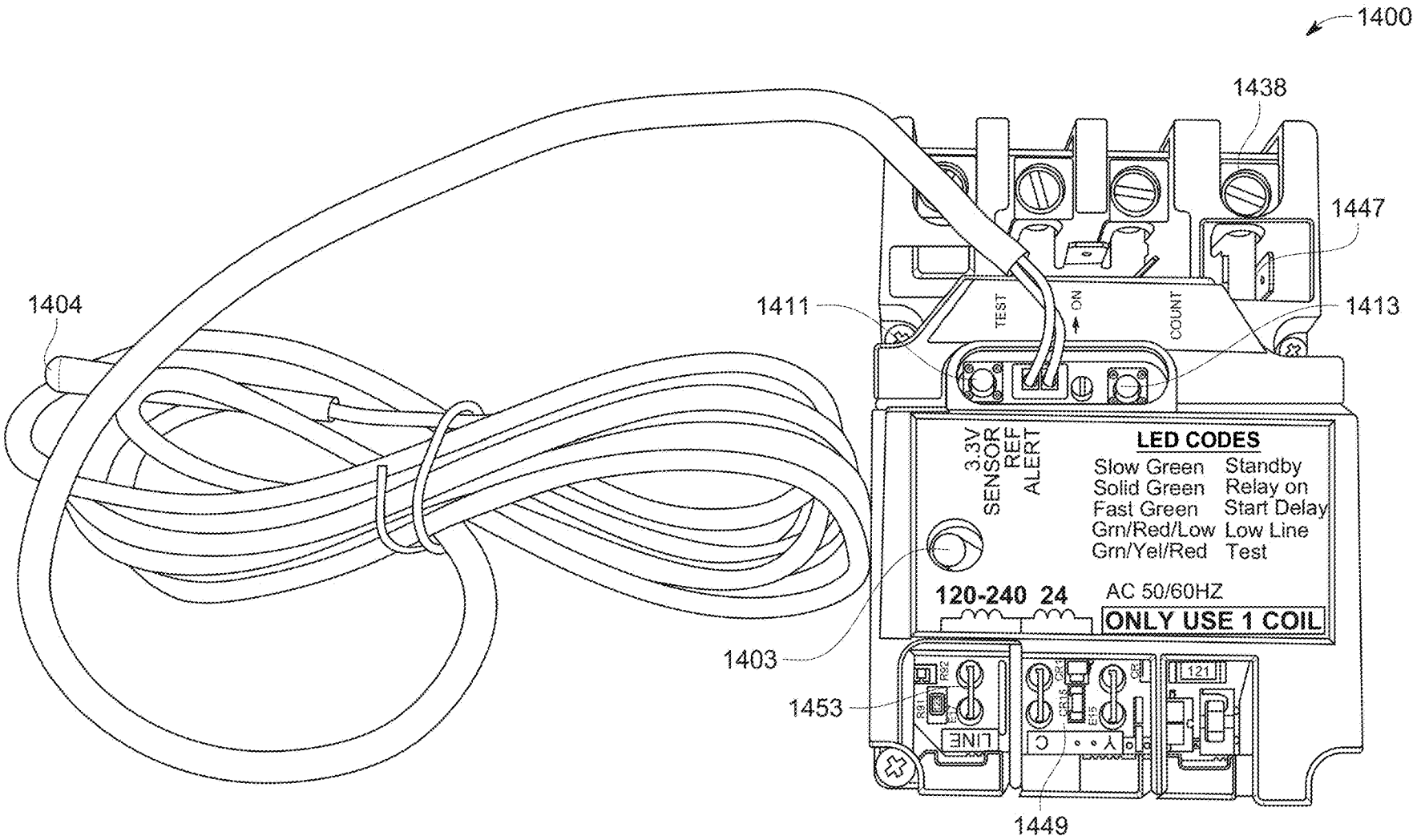
FIG. 14 illustrates an exemplary embodiment of a control and a negative temperature coefficient (NTC) thermistor probe (broadly, a temperature sensor) connected to the control.

FIG. 14 shows an exemplary embodiment of a control 1400 embodying one or more aspects of the present disclosure. In this exemplary embodiment, an NTC thermistor probe 1404 (broadly, a temperature sensor) is connected (e.g., via the circuit assembly shown in FIG. 3, etc.) with the control 1400.

The control 1400 may include a microprocessor and sealed relay. As shown in FIG. 14, the control 1400 includes an indicator light 1403 (e.g., a multi-color LED, other light source, etc.), which in the present example embodiment is a tri-color LED. The indicator light 1403 is operable by a microprocessor of the control 1400 to indicate faults, status, and/or the number of cycles through which the relay has cycled.

The control 1400 includes two push buttons 1411 and 1413 respectively indicated as "TEST" and "COUNT". An example operation and functionality of the onboard push buttons 1411 and 1413 ("TEST" and "COUNT") is disclosed in U.S. patent application Ser. No. 16/691,095, the entire disclosure of which is incorporated herein by reference. The control 1400 may include a first dipswitch usable to select/set a short cycle delay and a second dipswitch usable to select or deselect brownout protection as also disclosed in U.S. patent application Ser. No. 16/691,095.

The control 1400 includes a two-piece housing, e.g., a two-piece plastic housing with integral mounting features, etc. The two-piece housing includes an upper housing portion or cover and a lower housing portion. The housing may include openings in the upper housing portion or cover for terminal connections and connections to a compressor and fan, etc. Lug connectors 1438 are provided for line voltage inputs and outputs. Connectors 1447 are provided for connection of compressor and fan capacitors, fan, etc. to line voltages.

The control 1400 includes a printed circuit board (PCB) 1449 on which the microprocessor and sealed relay are provided. Although the PCB 1449 is horizontally situated relative to the housing bottom portion, a PCB could be oriented in other directions, e.g., vertically within the housing in other control embodiments, etc. Connectors 1453 are provided on the PCB 1449 for connection of the control 1400, e.g., with a thermostat.

The control 1400 may be provided, e.g., for use in relation to single stage air conditioning and heat pump condensing units with single-phase reciprocating or scroll compressors operating on standard residential and/or commercial (delta and/or wye) power configurations. The control 1400 may be used as an aftermarket field upgrade device to replace a traditional contactor, while incorporating additional value-added features, such as short cycle protection, brownout protection, random start delay, cycle count retention and light indicator display. In exemplary embodiments, a control is configured to operate using limited indoor unit input, e.g., from only two wires (Y1, C). Additionally, exemplary embodiments may provide for control of a two-stage compressor and thus may include an additional input (Y2) terminal and means for switching a second stage on/off. An example control may have brownout protection, e.g., similar to that disclosed in U.S. Pat. No. 6,647,346, the entire disclosure of which is incorporated herein by reference.

Various embodiments may include a single relay for the fan and compressor. But in other exemplary embodiments, a control may include more than one relay, e.g., as disclosed in U.S. Pat. Nos. 7,100,382, 7,444,824, 7,464,561, and/or 7,694,525, the entire disclosures of which are incorporated herein by reference.

The control 1400 may be used as a field replacement for a standard electromechanical contactor. A typical reason for the failure of standard open frame contactors is the intrusion into the contact area of insects, which foul the contacts and cause the contacts to fail. By using a sealed relay, the insect problem can be avoided and possibly eliminated.

Dipswitches may be used to provide various features. For example, a first dipswitch may be used to select/set a short cycle delay of, e.g., 0 or 180 seconds at 60 Hertz, 0 or 216 seconds at 50 Hertz, etc. A second dipswitch may be used to select or deselect brownout protection. A compressor lockout feature may be provided through dipswitch(es). The lockout feature allows an installer to select how many failed attempts to start a compressor connected to the control are to be allowed before the control locks out the compressor. This feature can help protect a compressor and motor from damage, e.g., if a HVAC system needs service. In some embodiments, when a control locks out the compressor, a message is displayed (e.g., on a thermostat display, etc.) to call for servicing. In some embodiments, a setting for the dipswitch(es) is provided that prevents lock out of the compressor regardless of the number of failed starts.

Referring again to the control 1400 shown in FIG. 14, example timing periods may include anti-short-cycle-delay of 0 seconds or 180 seconds (selectable) at 60 Hertz, and 0 seconds or 216 seconds (selectable) at 50 Hertz. Compressor test may be 5 seconds at 60 Hertz and 6 seconds at 50 Hertz. In an exemplary embodiment, the control 100 may be configured to have the following specifications or electrical ratings:

Line voltage input . . . 120/208/240/250 VAC, 50/60 Hz
Full load amperes . . . (FLA) 40 A
Locked rotor amperes . . . (LRA) 200 A
Control (Coil) voltage (Y, C) . . . 24 VAC, 50/60 Hz
(Line C) . . . 120/208/240/250 VAC, 50/60 Hz In exemplary embodiments, the control (e.g., 100 (FIG. 1), 200 (FIG. 2), 300 (FIG. 3), 700 (FIG. 7), 1300 (FIG. 13), 1400 (FIG. 14), etc.) may include a relay (e.g., a latching relay, etc.) electrically connected with a line voltage source and load (e.g., compressor motor, etc.). The relay may also be electrically connected with relay control and feedback. In turn, the relay control and feedback may be electrically connected with the microcontroller. The relay is operable by the microcontroller via the relay control and feedback to electrically connect or disconnect the line voltage source and load. The relay may be substantially enclosed in a seal (e.g., a coating of epoxy glue, etc.) that is configured to prevent the intrusion of foreign objects (e.g., insects, debris, contaminants, etc.) into contacts (not shown) of the relay. The control may include zero cross and voltage level detect. With the aid, e.g., of optical sensing of sparking at the relay, the microcontroller may be configured to provide "zero cross" switching of current through the relay such that current is switched through the relay at or very close to zero crossing of the line voltage. Such switching may be performed as disclosed in U.S. Pat. No. 7,464,561, the entire disclosure of which is incorporated herein by reference. Arcing and contact damage to the relay may thereby be reduced or eliminated.

Exemplary embodiments may also include a 5 VDC power supply, a 98-276V input AC/DC power supply, and user input/out devices. The user input/out devices may include switches (e.g., dipswitches, push button switches, other switches, etc.) and LEDs (e.g., multi-colored LEDs, other light sources, etc.).

In exemplary embodiments, the PCB and housing of the control may be configured to accommodate for the potential line voltage connections, e.g., 24 VAC, 120/208/240/250 VAC, etc. In exemplary embodiments, the control may be configured to be operable across or with a range of activation inputs, such as activation inputs ranging from 98 VAC to 276 VAC inputs (e.g., 120, 208, 240, 250, 24 VAC inputs, etc.) to switch loads of the same or different voltages.

In exemplary embodiments, a crankcase heater may be connected to line voltages. The crankcase heater may be, e.g., a "belly band" crankcase heater. The control may be connected with a fan motor, a fan capacitor, and a compressor capacitor. R and C terminals of the control may be connected, e.g., via lug type connectors, with R (run) and C (common) terminals of a compressor motor, etc. An S (start) terminal of the compressor motor may be connected with a HERM terminal of the compressor capacitor. The control may be connected with a C (common) terminal of the fan motor. The control may switch the fan motor on or off with the compressor motor through the relay. The fan motor may be, but is not limited to, e.g., a one-speed permanent split capacitor (PSC) motor for an outdoor fan, etc. R (run) and S (start) terminals of the fan motor may be connected with the fan capacitor. The control may be configured to be compatible with most, if not all, types of single-speed PSC outdoor fan motor wiring including 3-wire, 4-wire, and universal replacement motors. The control may also be configured so that it is compatible with both dual capacitor (separate compressor and outdoor fan) systems and single capacitor (combined compressor and outdoor fan) systems. The control may be further configured to be compatible with both 2-wire and 3-wire hard start kits.

In exemplary embodiments, the control may comprise a multi-voltage or universal contactor configured to be operable across or with a range of activation inputs, such as activation inputs ranging from 98 VAC to 276 VAC inputs (e.g., 120, 208, 240, 250, 24 VAC inputs, etc.), etc. For example, the multi-voltage contactor may be configured to accept a 120, 208, 240, 250, or 24 VAC activation input to switch loads of the same or different voltages. By way of comparison, an existing residential cooling specific design of a printed circuit board (PCB) mounted relay capable of high current compressor switching may be configured to only accept a 24 VAC input.

In exemplary embodiments, a control may include a circuit similar or identical to a circuit of a microprocessor-controlled replacement for a standard contactor as disclosed in U.S. Pat. No. 10,209,751, the entire disclosure of which is incorporated herein by reference. In exemplary embodiments, the control may be configured to include the following features:

- The power supply may be configured to run on 98-276 VAC inputs.
- The coil/control circuit may be configured to run on 120/208/240/250V input or 24V input, with ground or neutral reference.
- A firmware algorithm may be provided to account for brownout.
- A firmware algorithm may be provided to account for phase difference between the switched voltage and the coil voltage. This may include a routine that samples throughout the line cycle and looks for a balance of high and low signals indicating an AC signal.
- A common connector and two potential power connections may be provided for the "coil" connection. A sliding plastic door may help prevent miswiring such that only one of the power connections (120/208/240/250V or 24V) is available to connect at a time. The door may only enable connection to the low voltage AC power or the line voltage source.
- A wiring box may be integrated into a plastic enclosure with the potential for an optional compressor switch.
- A method of detecting AC voltage may also be included.

With the ability to accept a range of activation inputs (e.g., 98-276 VAC inputs, or 120, 208, 240, 250, or 24 VAC inputs, etc.) to switch loads of the same or different voltages, exemplary embodiments of the controls disclosed herein may be used to replace multiple different voltage-specific contactors. For example, a multi-voltage contactor may be used as a multi-voltage electronic replacement for mechanical compressor contactors, which typically are voltage specific on the coil side.

Exemplary embodiments may also provide benefits of an enclosed PCB mounted relay with zero cross capability that can be used on multiple voltages and phases. Exemplary embodiments may also include an integrated wiring box that allows for reduced number of parts required by the original equipment manufacturer (OEM).

In exemplary embodiments, a control may include a high-reliability, optically-controlled latching relay, sealed against the intrusion of insects and debris, and that is operable with or across a range of activation inputs, such as activation inputs ranging from 98 VAC to 276 VAC inputs (e.g., 120, 8, 240, 250, 24 VAC inputs, etc.), etc. Various embodiments may provide line voltage brownout protection by de-energizing a compressor, e.g., in the event of calls for compressor operation during line voltage drops. Various embodiments may provide short cycle protection, e.g., by activating a short delay before normal operation for compressors in air conditioners and heat pumps. Controls in exemplary embodiments may also detect inputs from high and low pressure switches and lock out compressor operation, e.g., when multiple consecutive pressure switch openings are detected. Additionally or alternatively, example embodiments of controls may include a cycle counter feature that a user may activate by push button, to determine and display how many times a compressor relay has turned on. Additionally or alternatively, example embodiments of controls may include a random start delay timer function, e.g., as further described below.

An example embodiment of a control disclosed herein may be configured for use as a field replacement suitable for replacing any of a plurality of different configurations (e.g., up to 5 ton/40 A, 1-pole, 1.5 pole, 2-pole configurations, etc.) of contactors. Example embodiments may be relatively easy to install, e.g., using lug connectors and a mounting plate that can be installed in the same location previously occupied by a conventional contactor. In various embodiments, controls may be self-powered and/or may be wired into existing wiring without requiring any new wires.

The control 1300 may be self-powered and/or may be configured with a power stealing feature in exemplary embodiments. In various embodiments, the control 1300 may include its own power supply such that an installer is not required to pull additional wires to the outdoor unit.

In addition to being operable across or with a range of activation inputs, such as activation inputs ranging from 98 VAC to 276 VAC inputs (e.g., 120, 208, 240, 250, 24 VAC inputs, etc.), exemplary embodiments may also include or provide one or more of (but not necessarily any or all of) the following features, functions, and benefits. For example, reliability may be improved at least due to one or more of the following features in various embodiments.

(a) Control relay contacts are enclosed in a seal, thereby preventing insects, debris, and other contaminants from getting into the relay.
(b) Relay smart "zero cross" switching can inhibit contact damage and improve cycle life.
(c) Line voltage brownout protection is selectable to deactivate operation in excessively low voltage conditions, on start-up, and/or during run.
(d) Short cycle protection is selectable, e.g., to maintain equal system pressure conditions.
(e) The latching relay can reduce or eliminate chatter and can reduce VA draw (e.g., zero chatter latching relay, etc.).

Exemplary embodiments may include a reliable one-million-cycle rated, sealed electronic switch with microprocessor control that inhibits arcing that may otherwise cause contact welding and pitting. In exemplary embodiments, the switch may be provided in a seal that prevents insects, ants, debris, etc. from entering the switch and saves on pest control treatment.

Exemplary embodiments may allow for one contactor part number to replace the following contactor applications, including (1) AC contactors that operate on 24 VAC that allow for proper operation of legacy thermostats (e.g., mechanical thermostats with anticipation, power stealing); (2) Refrigeration contactors that use 120 V, 208 V, 240 V, or 250 VAC coils; and (3) Non-Compressor applications (e.g., motors, fans, etc.) with coils of 24 VAC, 120 VAC, 208 VAC, 240 VAC, or 250 VAC.

Exemplary embodiments may include a door or other covering for the terminals to aid in hook up of a multi-voltage connection. Exemplary embodiments may include a fuse or protective device in the current path of the 24 VAC control signal. The fuse or protective device may protect against miswiring.

Exemplary embodiments may be configured with brown-out auto detect implemented via a firmware algorithm (e.g., within a microprocessor, etc.) for determining input voltage and adjusting brownout threshold, such as disclosed in U.S. patent application Ser. No. 16/691,095.

Exemplary embodiments of the controls and methods disclosed herein may be applied to or used with compressors of vapor compression systems. The vapor compression systems may include vapor compression refrigeration systems used for conditioning air (e.g., to be supplied to a climate controlled comfort zone or interior space, etc.) or in refrigerating air (e.g., to be supplied to a freezer, etc.). The refrigerant (broadly, working fluid) in a refrigerant vapor compression system may be a hydrochlorofluorocarbon refrigerant, hdyrofluorocarbon refrigerant, carbon dioxide and refrigerant mixtures containing carbon dioxide. Exemplary embodiments of the controls and methods disclosed herein may also be applied to or used with compressors of vapor compressor non-refrigeration systems charged with working fluids that are not necessarily refrigerants.

Although the term "relay switch control" may be used herein to refer to various exemplary embodiments, various types of controls, controllers, hardware, software, combinations thereof, etc. could also be used. Various types of processors, microprocessors, computers, etc. could also be utilized in accordance with various implementations of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A control configured for connection with one or more line voltage sources and one or more components including a compressor, the control comprising:

a processor;

a relay operable by the processor to electrically connect or disconnect the one or more line voltage sources; and a control circuit configured to be coupled for communication with and/to transmit control signals to the processor;

wherein the processor is configured to be coupled for communication with:

a temperature sensor configured to be operable for obtaining temperature readings of a suction line; and a liquid detection sensor configured to be operable for detecting liquid within the compressor;

wherein the temperature sensor is a single negative temperature coefficient (NTC) temperature sensor configured to be operable for obtaining temperature readings of the suction line, and the processor is configured to receive analog signals of the temperature readings of the suction line obtained by the single NTC temperature sensor;

wherein the liquid detection sensor is a single optical liquid detection sensor configured to be operable for detecting liquid within the compressor, and the processor is configured to receive digital signals from the single optical liquid detection sensor;

whereby the control is configured to be operable for providing liquid migration protection for the compressor during an OFF cycle of system demand and/or liquid floodback protection for the compressor during the ON cycle of system demand.

2. The control of claim 1, wherein the control includes one or more terminals, and wherein:

the single NTC temperature sensor is coupled directly with the processor via a corresponding terminal of the control; and the single optical liquid detection sensor is coupled directly with the processor via a corresponding terminal of the control.

3. The control of claim 1, wherein:

the single NTC temperature sensor comprises a negative temperature coefficient (NTC) thermistor probe in series with user-adjustable resistance, and the processor is coupled for communication with and receives analog signals from the NTC thermistor probe; and the single optical liquid detection sensor comprises an optical level switch, and the processor is coupled for communication with and receives digital signals from the optical level switch.

4. The control of claim 1, wherein the control is configured to:

allow energizing of the compressor for normal operation if the liquid detection sensor does not detect working fluid in the liquid state within the compressor after a call for cool; and inhibit energizing of the compressor for normal operation if the liquid detection sensor detects working fluid in the liquid state within the compressor after a call for cool, thereby allowing for liquid migration mitigation before the compressor is energized for normal operation.

5. The control of claim 1, wherein the processor is coupled for communication with the single NTC temperature sensor and the single optical liquid detection sensor.

6. The control of claim 5, wherein the control is configured to be operable for providing liquid migration protection for the compressor during an OFF cycle of system demand and for providing liquid floodback protection for the compressor during the ON cycle of system demand.

7. The control of claim 6, wherein:

the single NTC temperature sensor comprises a negative temperature coefficient (NTC) thermistor probe in series with user-adjustable resistance, and the processor is coupled for communication with and receives analog signals from the NTC thermistor probe; and the single optical liquid detection sensor comprises an optical level switch, and the processor is coupled for communication with and receives digital signals from the optical level switch.

8. The control of claim 1, wherein the control is configured to be operable for controlling the compressor by using the liquid detection sensor for determining if liquid is within the compressor and by using the temperature readings of the suction line obtained by the temperature sensor for determining if suction temperature is greater than a predetermined error threshold away from a user defined average suction temperature.

9. The control of claim 8, wherein the control is configured such that if it is determined that the suction temperature is greater than the predetermined error threshold away from the user defined average suction temperature, then the control is operable for:

turning off the compressor;

indicating an error;

determining whether one or more reset conditions are met; and if it is determined that the one or more reset conditions are met, then the control uses the liquid detection sensor to determine if liquid is within the compressor in response to a call for cool.

10. The control of claim 1, wherein the control is configured to be operable for:

using the liquid detection sensor to determine if liquid is within the compressor in response to a call for cool; and if liquid is sensed within the compressor, running a compressor bump start routine a predetermined number of times, and after completion of the predetermined number of times of the compressor bump start routine, using the liquid detection sensor to determine if liquid is within the compressor;

stopping liquid migration mitigation efforts and indicating an error if liquid is sensed within the compressor after completion of the predetermined number of times of the compressor bump start routine; or turning on the compressor if liquid is not sensed within the compressor by the liquid detection sensor after completion of the predetermined number of times of the compressor bump start routine.

11. The control of claim 1, wherein the control is configured to be operable for turning on and off the compressor and for displaying an indication of an error.

12. The control of claim 1, wherein the control is configured to be operable for:

using the liquid detection sensor to determine if liquid is sensed within the compressor in response to a call for cool; and inhibiting energizing of the compressor for normal operation if liquid is sensed within the compressor after a call for cool, thereby allowing for liquid migration mitigation before the compressor is energized for normal operation;

wherein after turning on the compressor, the control is configured to be operable for:

using the temperature sensor for measuring suction temperature at predetermined time intervals;

determining whether the suction temperature is greater than a predetermined error threshold away from a user defined average suction temperature; and if it is determined that the suction temperature is greater than the predetermined error threshold away from the user defined average suction temperature then the control is operable for:

turning off the compressor;

indicating an error; and determining whether one or more reset conditions are met.

13. The control of claim 12, wherein the control is configured to be operable for determining whether the compressor has been on for a predetermined amount of time; and then using the temperature sensor for measuring suction temperature at predetermined time intervals after it has been determined that the compressor has been on for the predetermined amount of time.

14. The control of claim 1, wherein the control is configured to be operable for:

using the liquid detection sensor to determine if liquid is sensed within the compressor in response to a call for cool;

inhibiting energizing of the compressor for normal operation if liquid is sensed within the compressor after a call for cool, thereby allowing for liquid migration mitigation before the compressor is energized for normal operation;

wherein after turning on the compressor, the control is configured to be operable for:

using the temperature sensor for measuring suction temperature at predetermined time intervals;

determining whether the suction temperature is at steady state;

if it is determined that the suction temperature is at steady state, using the suction temperature to update the suction temperature average;

after using the suction temperature to update the suction temperature average and if the suction temperature average is determined, determining whether the suction temperature is greater than a predetermined error threshold away from a user defined average suction temperature; and if it is determined that the suction temperature is greater than the predetermined error threshold away from the user defined average suction temperature then the control is operable for:

turning off the compressor;

indicating an error; and determining whether one or more reset conditions are met.

15. The control of claim 14, wherein the control is configured to be operable for:

determining whether the suction temperature is at steady state by comparing previous readings of suction temperature to determine if the rate of change of suction temperature is below a threshold; and/or using the suction temperature to update the suction temperature average by using a moving average or an allowable increment up or down based on suction temperature; and/or debouncing a comparison of the suction temperature with the predetermined error threshold and the user defined average suction temperature.

16. The control of claim 1, wherein the control is configured to be operable for:

using the liquid detection sensor to determine if liquid is sensed within the compressor in response to a call for cool; and inhibiting energizing of the compressor for normal operation if liquid is sensed within the compressor after a call for cool, thereby allowing for liquid migration mitigation before the compressor is energized for normal operation;

wherein after turning on the compressor, the control is configured to be operable for:

using the temperature sensor for measuring suction temperature at predetermined time intervals;

determining whether the suction temperature is at steady state;

if it is determined that the suction temperature is at steady state, determining whether a call for cool counter is within a predetermined range;

if it is determined that the call for cool counter is not within the predetermined range and that the call for cool counter does not exceed the predetermined range, determining whether the suction temperature is greater than a predetermined error threshold away from a user defined average suction temperature; and if it is determined that the suction temperature is greater than the predetermined error threshold away from the user defined average suction temperature then the control is operable for:

turning off the compressor;

indicating an error; and determining whether one or more reset conditions are met.

17. The control of claim 16, wherein the control is configured to be operable for:

determining whether the suction temperature is at steady state by comparing previous readings of suction temperature to determine if the rate of change of suction temperature is below a threshold; and/or using the suction temperature to update the suction temperature average by using a moving average or an allowable increment up or down based on suction temperature; and/or debouncing a comparison of the suction temperature with the predetermined error threshold and the user defined average suction temperature.

18. A control configured for connection with a compressor, the control comprising:

a processor;

a control circuit configured to be coupled for communication with and/to transmit control signals to the processor;

wherein the processor is configured to be coupled for communication with:

a temperature sensor configured to be operable for obtaining temperature readings of a suction line; and a liquid detection sensor configured to be operable for detecting liquid within the compressor;

wherein the temperature sensor is a single negative temperature coefficient (NTC) temperature sensor configured to be operable for obtaining temperature readings of the suction line, and the processor is configured to receive analog signals of the temperature readings of the suction line obtained by the single NTC temperature sensor;

wherein the liquid detection sensor is a single optical liquid detection sensor configured to be operable for detecting liquid within the compressor, and the processor is configured to receive digital signals from the single optical liquid detection sensor;

whereby the control is configured to be operable for controlling the compressor by using the liquid detection sensor for determining if liquid is within the compressor and by using the temperature readings of the suction line obtained by the temperature sensor for determining if suction temperature is greater than a predetermined error threshold away from a user defined average suction temperature.

19. The control of claim 18, wherein the control is configured to:

allow energizing of the compressor for normal operation if the liquid detection sensor does not detect working fluid in the liquid state within the compressor after a call for cool; and inhibit energizing of the compressor for normal operation if the liquid detection sensor detects working fluid in the liquid state within the compressor after a call for cool, thereby allowing for liquid migration mitigation before the compressor is energized for normal operation.

20. The control of claim 18, wherein the control is configured such that if it is determined that the suction temperature is greater than the predetermined error threshold away from the user defined average suction temperature, then the control is operable for:

turning off the compressor;

indicating an error;

determining whether one or more reset conditions are met; and if it is determined that the one or more reset conditions are met, then the control uses the liquid detection sensor to determine if liquid is within the compressor in response to a call for cool.

21. A control configured for connection with a compressor, the control comprising:

a processor; and to a control circuit configured to be coupled for communication with and to transmit control signals to the processor;

wherein the processor is configured to be coupled for communication with:

a temperature sensor configured to be operable for obtaining temperature readings of a suction line; and a liquid detection sensor configured to be operable for detecting liquid within the compressor;

wherein the temperature sensor is a single negative temperature coefficient (NTC) temperature sensor configured to be operable for obtaining temperature readings of the suction line, and the processor is configured to receive analog signals of the temperature readings of the suction line obtained by the single NTC temperature sensor;

wherein the liquid detection sensor is a single optical liquid detection sensor configured to be operable for detecting liquid within the compressor, and the processor is configured to receive digital signals from the single optical liquid detection sensor;

whereby the control is configured to be operable for:

using the liquid detection sensor to determine if liquid is sensed within the compressor in response to a call for cool; and inhibiting energizing of the compressor for normal operation if liquid is sensed within the compressor after a call for cool, thereby allowing for liquid migration mitigation before the compressor is energized for normal operation;

wherein after turning on the compressor, the control is configured to be operable for:

using the temperature sensor for measuring suction temperature at predetermined time intervals; and determining whether the suction temperature is greater than a predetermined error threshold away from a user defined average suction temperature.

22. The control of claim 21, wherein the control is configured such that if it is determined that the suction temperature is greater than the predetermined error threshold away from the user defined average suction temperature then the control is operable for:

turning off the compressor;

indicating an error; and determining whether one or more reset conditions are met.

23. The control of claim 21, wherein the control is configured to be operable for determining whether the compressor has been on for a predetermined amount of time; and then using the temperature sensor for measuring suction temperature at predetermined time intervals after it has been determined that the compressor has been on for the predetermined amount of time.

* * * * *